US007317432B2

(12) United States Patent
Koyama

(10) Patent No.: US 7,317,432 B2
(45) Date of Patent: Jan. 8, 2008

(54) LIGHT EMITTING DEVICE AND METHOD OF DRIVING THE SAME

(75) Inventor: Jun Koyama, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 354 days.

(21) Appl. No.: 10/882,287

(22) Filed: Jul. 2, 2004

(65) Prior Publication Data

US 2004/0239599 A1 Dec. 2, 2004

Related U.S. Application Data

(62) Division of application No. 09/983,479, filed on Oct. 24, 2001.

(30) Foreign Application Priority Data

Oct. 24, 2000 (JP) ..... 2000-323543
Nov. 24, 2000 (JP) ..... 2000-358274

(51) Int. Cl.
*G09G 3/30* (2006.01)

(52) U.S. Cl. ..... 345/76; 345/82; 345/84; 345/92; 345/204; 315/169.1; 315/169.3

(58) Field of Classification Search ..... 345/76–85, 345/204–212; 315/169.1–169.4
See application file for complete search history.

(56) References Cited

U.S. PATENT DOCUMENTS 3,659,159 A * 4/1972 Nagata ..... 345/3.1
5,235,253 A * 8/1993 Sato ..... 315/169.3
5,610,628 A * 3/1997 Yamamoto et al. ..... 345/100
5,990,629 A 11/1999 Yamada et al.

(Continued)

FOREIGN PATENT DOCUMENTS

EP 0 895 219 A1 2/1999

(Continued)

OTHER PUBLICATIONS

Bae et al.; "A Novel Pixel Design for an Active Matrix Organic Light Emitting Diode Display"; *SID 2000*; pp. 358-361; 2000.

(Continued)

*Primary Examiner*—Vijay Shankar
(74) *Attorney, Agent, or Firm*—Fish & Richardson P.C.

(57) ABSTRACT

A method of driving a display device capable of obtaining a luminance of constant level irrespective of temperature change is provided. A change in luminance of an EL element due to temperature change is prevented by controlling the luminance of the EL element with current instead of voltage. Specifically, a TFT for controlling the amount of current flowing into the EL element is operated in a saturation range. Then a current value $I_{DS}$ of the TFT is hardly changed by $V_{DS}$ but is determined solely by $V_{GS}$. Accordingly, the amount of current flowing in the EL element is kept constant by setting $V_{GS}$ to such a value as to make the current value $I_{DS}$ constant. The luminance of the EL element is substantially in proportion to the amount of current flowing through the EL element, and a change in luminance of the EL element upon temperature change can thus be prevented.

6 Claims, 27 Drawing Sheets

U.S. PATENT DOCUMENTS

| | | | | |
|---|---|---|---|---|
| 6,023,259 | A | 2/2000 | Howard et al. | |
| 6,091,203 | A | 7/2000 | Kawashima et al. | |
| 6,229,506 | B1 * | 5/2001 | Dawson et al. | 345/82 |
| 6,246,180 | B1 | 6/2001 | Nishigaki | |
| 6,304,304 | B1 * | 10/2001 | Koma | 349/33 |
| 6,373,454 | B1 | 4/2002 | Knapp et al. | |
| 6,462,722 | B1 | 10/2002 | Kimura et al. | |
| 6,509,690 | B2 | 1/2003 | Sempel et al. | |
| 6,522,315 | B2 | 2/2003 | Ozawa et al. | |
| 6,542,138 | B1 | 4/2003 | Shannon et al. | |
| 6,577,302 | B2 | 6/2003 | Hunter et al. | |
| 6,580,408 | B1 | 6/2003 | Bae et al. | |
| 6,734,836 | B2 | 5/2004 | Nishitoba | |
| 6,750,833 | B2 | 6/2004 | Kasai | |
| 6,839,045 | B2 | 1/2005 | Ozawa et al. | |
| 2001/0026251 | A1 | 10/2001 | Hunter et al. | |
| 2002/0024493 | A1 | 2/2002 | Ozawa et al. | |
| 2002/0027422 | A1 | 3/2002 | Sempel et al. | |
| 2002/0043991 | A1 | 4/2002 | Nishitoba | |
| 2002/0047568 | A1 | 4/2002 | Koyama | |
| 2002/0047581 | A1 | 4/2002 | Koyama | |
| 2002/0047839 | A1 | 4/2002 | Kasai | |
| 2002/0097213 | A1 | 7/2002 | Ozawa et al. | |
| 2002/0196206 | A1 | 12/2002 | Kimura et al. | |
| 2003/0098827 | A1 | 5/2003 | Ozawa et al. | |
| 2003/0231273 | A1 | 12/2003 | Kimura et al. | |
| 2004/0150591 | A1 | 8/2004 | Ozawa et al. | |
| 2004/0233143 | A1 | 11/2004 | Kasai | |

FOREIGN PATENT DOCUMENTS

| | | | |
|---|---|---|---|
| EP | 0 917 127 | A1 | 5/1999 |
| EP | 1 191 512 | A2 | 3/2002 |
| EP | 1 255 240 | A1 | 11/2002 |
| EP | 1 336 953 | A2 | 8/2003 |
| EP | 1 337 131 | A2 | 8/2003 |
| EP | 1 359 789 | A1 | 11/2003 |
| EP | 1 363 265 | A2 | 11/2003 |
| JP | 04-328791 | | 11/1992 |
| JP | 09-16122 | | 1/1997 |
| JP | 10-333641 | | 12/1998 |
| JP | 11-282419 | | 10/1999 |
| JP | 2000-40924 | | 2/2000 |
| JP | 2002-056847 | | 2/2000 |
| JP | 2000-138572 | | 5/2000 |
| JP | 2000-221942 | | 8/2000 |
| JP | 2000-235370 | | 8/2000 |
| JP | 2002-124377 | | 4/2002 |
| JP | 2002-169510 | | 6/2002 |
| JP | 2003-529805 | | 10/2003 |
| JP | 2003-534573 | | 11/2003 |
| WO | WO98-33165 | | 7/1998 |
| WO | WO98/036407 | | 8/1998 |
| WO | WO98/048403 | | 10/1998 |
| WO | WO99-38148 | | 7/1999 |
| WO | WO99-65011 | | 12/1999 |
| WO | WO 01/006484 | | 1/2001 |
| WO | WO 01/075852 | | 10/2001 |
| WO | WO 01/091094 | | 11/2001 |

OTHER PUBLICATIONS

Baldo et al.; "Highly Efficient Phosphorescent Emission From Organic Electroluminescent Devices" *Nature*, vol. 395; pp. 151-154; Sep. 10, 1998.

Baldo et al.; "Very High-Efficiency Green Organic Light-Emitting Devices Based on Electrophosphorescence"; *Applied Physics Letters*, vol. 75, No. 1; pp. 4-6; Jul. 5, 1999.

Dawson et al.; "The Impact of the Transient Response of Organic Light Emitting Diodes on the Design of Active Matrix OLED Displays"; *IEDM 98*; pp. 875-878; 1998.

Dawson et al.; "A Poly-Si Active-Matrix OLED Display with Integrated Drivers"; *SID 99 Digest*; pp. 438-441; 1999.

Dawson et al.; "Design of an Improved Pixel for a Polysilicon Active-Matrix Organic LED Display"; *SID 98 Digest*; pp. 11-14; 1998.

Hunter et al.; "Active Matrix Addressing of Polymer Light Emitting Diodes Using Low Temperature Poly Silicon TFTs"; *AM-LCD 2000*; pp. 249-252; 2000.

Kimura et al.; "Low-Temperature Poly-Si TFT Display using Light-Emitting-Polymer"; *AM-LCD 2000*; pp. 245-248; 2000.

Tsutsui et al.; "Electroluminescence in Organic Thin Films"; *Photochemical Processes in Organized Molecular Systems*; pp. 437-450; 1991.

Tsutsui et al.; "High Quantum Efficiency in Organic Light-Emitting Devices with Iridium-Complex as a Triplet Emissive Center"; *Japanese Journal of Applied Physics*, vol. 38, Part 12B; pp. L1502-L1504; Dec. 15, 1999.

Singapore Search Report and Written Opinion (Application No. 200106179-5), Dec. 27, 2004, 8 pages.

* cited by examiner

LIGHT EMITTING DEVICE AND METHOD OF DRIVING THE SAME

CROSS-REFERENCE TO RELATED APPLICATIONS

This application is a divisional application of U.S. application Ser. No. 09/983,479, filed Oct. 24, 2001 now allowed, which claims the benefit of foreign priority applications filed in Japan on Oct. 24, 2000, as serial numbers 2000-323543 and on Nov. 24, 2000 as serial number 2000-358274. This application claims priority to each of these prior applications, and the disclosures of the prior applications are considered part of (and are incorporated by reference in) the disclosure of this application.

BACKGROUND OF THE INVENTION

1. Field of the Invention

The present invention relates to an EL panel in which an EL element formed on a substrate is sealed between the substrate and a cover member, and to a method of driving the EL panel. The invention also relates to an EL module obtained by mounting an IC to the EL panel, and to a method of driving the EL module. The EL panel and the EL module are generically called light emitting devices in this specification. Also, in the present invention electronic machines using light emitting devices that display images when driven by the driving methods are included.

2. Description of the Related Art

Being self-luminous, EL elements eliminate the need for a backlight that is necessary in liquid crystal displays (LCDs) and thus make it easy to manufacture thinner displays. Also, the self-luminous EL elements are high in visibility and have no limit in terms of viewing angle. These are the reasons for attention that light emitting devices using the EL elements are receiving in recent years as display devices to replace CRTs and LCDs.

An EL element has a layer containing an organic compound that provides luminescence (electroluminescence) when an electric field is applied (the layer is hereinafter referred to as EL layer), in addition to an anode layer and a cathode layer. Luminescence obtained from organic compounds is classified into light emission upon return to a base state from singlet excitation (fluorescence) and light emission upon return to a base state from triplet excitation (phosphorescence). A light emitting device according to the present invention can use both types of light emission.

All the layers that are provided between an anode and a cathode are an EL layer in this specification. Specifically, the EL layer includes a light emitting layer, a hole injection layer, an electron injection layer, a hole transporting layer, an electron transporting layer, etc. A basic structure of an EL element is a laminate of an anode, a light emitting layer, and a cathode layered in this order. The basic structure can be modified into a laminate of an anode, a hole injection layer, a light emitting layer, and a cathode layered in this order, or a laminate of an anode, a hole injection layer, a light emitting layer, an electron transporting layer, and a cathode layered in this order.

In this specification, an EL element emitting light is expressed as an EL element being driven. The EL element as defined herein is a light emitting element that is composed of an anode, an EL layer, and a cathode.

Methods of driving a light emitting device having an EL element are roughly divided into analog driving methods and digital driving methods. Digital driving is deemed more promising in view of transition from analog broadcasting to digital broadcasting since it enables the light emitting device to display an image using a digital video signal that carries image information as it is without converting the signal into an analog signal.

There are two types of gray scale display methods that utilize binary voltages of digital video signals: one is an area ratio driving method and the other is a time division driving method.

The area ratio driving method is a driving method in which a pixel is divided into a plurality of sub-pixels and each sub-pixel is individually driven in accordance with a digital video signal to obtain gray scale display. Since the area ratio driving method involves dividing one pixel into plural sub-pixels and driving each sub-pixel individually, a pixel electrode is needed for every sub-pixel. This complicates the pixel structure, causing inconveniences.

The time division driving method, on the other hand, is a driving method that provides gray scale display by controlling the length of time pixels are lit. Specifically, one frame period is divided into a plurality of sub-frame periods. In each sub-frame period, to be lit or not is determined for the respective pixels in accordance with digital video signals. The accumulated lengths of sub-frame periods during which a pixel is lit with respect to the length of the entire sub-frame periods in one frame period determine the gray scale of that pixel.

Organic EL materials in general have faster response speed than liquid crystals, which makes an EL element suitable for time division driving.

Described below is the pixel structure of a common light emitting device driven by time division driving. The description is given with reference to FIG. 25.

FIG. 25 is a circuit diagram of a pixel 9004 of a common light emitting device. The pixel 9004 has one of source signal lines (source signal line 9005), one of power supply lines (power supply line 9006), and one of gate signal lines (gate signal line 9007). The pixel 9004 also has a switching TFT 9008 and an EL driving TFT 9009. The switching TFT 9008 has a gate electrode connected to the gate signal line 9007. The switching TFT 9008 has a source region and a drain region one of which is connected to the source signal line 9005 and the other of which is connected to a gate electrode of the EL driving TFT 9009 and to a capacitor 9010. Each pixel of the light emitting device has one capacitor.

The capacitor 9010 is provided to hold the gate voltage (the difference in electric potential between the gate electrode and a source region) of the EL driving TFT 9009 when the switching TFT 9008 is not selected (when the TFT 9008 is in an OFF state).

The source region of the EL driving TFT 9009 is connected to the power supply line 9006 whereas a drain region thereof is connected to an EL element 9011. The power supply line 9006 is connected to the capacitor 9010.

The EL element 9011 comprises of an anode, a cathode, and an EL layer placed between the anode and the cathode. If the anode is in contact with the drain region of the EL driving TFT 9009, the anode serves as a pixel electrode whereas the cathode serves as an opposite electrode. On the other hand, the cathode serves as the pixel electrode whereas the anode serves as the opposite electrode if the cathode is in contact with the drain region of the EL driving TFT 9009.

The opposite electrode of the EL element 9011 is given with an opposite electric potential. The power supply line 9006 is given with a power supply electric potential. The power supply electric potential and the opposite electric potential are provided by a power source placed in an external IC to the display device.

The operation of the pixel shown in FIG. 25 is described next.

A selection signal is inputted to the gate signal line 9007 to turn ON the switching TFT 9008, through which a digital signal carrying image information (hereinafter the signal is referred to as digital video signal) and inputted to the source signal line 9005 is inputted to the gate electrode of the EL driving TFT 9009.

The digital video signal inputted to the gate electrode of the EL driving TFT 9009 contains information, which is '1' or '0' and used to control switching of the EL driving TFT 9009.

When the EL driving TFT 9009 is turned OFF, the electric potential of the power supply line 9006 is not given to the pixel electrode of the EL element 9011 and therefore the EL element 9011 does not emit light. On the other hand, when the EL driving TFT 9009 is turned ON, the electric potential of the power supply line 9006 is given to the pixel electrode of the EL element 9011 to cause the EL element 9011 to emit light.

The above operation is conducted in each pixel, whereby an image is displayed.

In the light emitting device that displays an image through the above operation, however, the luminance of the EL element changes when the temperature is changed in the EL layer of the EL element due to the temperature of the surroundings or heat generated from the EL panel itself. FIG. 26 shows a change in voltage-current characteristic of the EL element when the temperature of the EL layer is changed. The current flowing through the EL element is reduced as the temperature of the EL layer is lowered. On the other hand, the current flowing through the EL element is increased as the temperature of the EL layer is raised.

The less the current flows in the EL element, the more the EL element loses the luminance. The more the current flows in the EL element, the more the EL element gains the luminance. Accordingly, the luminance of the EL element is changed when a change in temperature causes a shift in amount of current flowing in the EL layer even though the voltage applied to the EL element is constant.

The degree of change in luminance due to temperature change varies between EL materials. Therefore, if different EL materials are used in different EL elements in order to emit light of different colors for color display, a change in temperature can cause varying degree of changes in luminance in the EL elements of different colors to make it impossible to obtain desired color.

SUMMARY OF THE INVENTION

The present invention has been made in view of the problem above, and an object of the present invention is to provide a light emitting device capable of obtaining a constant luminance irrespective of temperature change and a method of driving the light emitting device.

The present inventors have thought of preventing a change in luminance of EL elements due to temperature change by controlling the luminance of the EL elements with current instead of voltage.

In order to cause a constant current to flow in an EL element, a TFT for controlling the amount of current flowing into the EL element is operated in a saturation range and the drain current of the TFT is kept constant. The TFT can be operated in the saturation range if the following Equation 1 is satisfied.

$$|V_{GS}-V_{TH}|<|V_{DS}| \quad \text{Equation 1}$$

wherein $V_{GS}$ is the difference in electric potential between a gate electrode and a source region, $V_{TH}$ is the threshold, and $V_{DS}$ is the difference in electric potential between a drain region and the source region.

When the drain current (the current flowing in a channel formation region) of the TFT is given as IDS, the mobility of the TFT as μ, the gate capacitance per unit area as $C_o$, the ratio of a channel width W to a channel length L of the channel formation region as W/L, the threshold as $V_{TH}$, and the mobility as μ, the following Equation 2 is satisfied in the saturation range.

$$I_{DS}=\mu C_o W/L\times(V_{GS}-V_{TH})^2/2 \quad \text{Equation 2}$$

As can be known from Equation 2, the drain current IDS in the saturation range is hardly changed by $V_{DS}$ but is determined solely by $V_{GS}$. Accordingly, the amount of current flowing in the EL element is kept constant by setting $V_{GS}$ to such a value as to make the current value $I_{DS}$ constant. The luminance of the EL element is substantially in proportion to the amount of current flowing through the EL element, and a change in luminance of the EL element upon temperature change can thus be prevented.

The structure of the present invention is shown in the following.

The present invention provides a light emitting device having a plurality of pixels each including a first TFT, a second TFT, a third TFT, a fourth TFT, an EL element, a source signal line, and a power supply line, the device characterized in that:

the third TFT and the fourth TFT are connected to each other at their gate electrodes;

the third TFT has a source region and a drain region one of which is connected to the source signal line and the other of which is connected to a drain region of the first TFT;

the fourth TFT has a source region and a drain region one of which is connected to the drain region of the first TFT and the other of which is connected to a gate electrode of the first TFT;

a source region of the first TFT is connected to the power supply line and the drain region thereof is connected to a source region of the second TFT; and a drain region of the second TFT is connected to one of two electrodes of the EL element.

The present invention provides a light emitting device having a plurality of pixels each including a first TFT, a second TFT, a third TFT, a fourth TFT, an EL element, a source signal line, a first gate signal line, a second gate signal line, and a power supply line, the device characterized in that:

the third TFT and the fourth TFT are both connected to the first gate signal line at their gate electrodes;

the third TFT has a source region and a drain-region one of which is connected to the source signal line and the other of which is connected to a drain region of the first TFT;

the fourth TFT has a source region and a drain region one of which is connected to the drain region of the first TFT and the other of which is connected to a gate electrode of the first TFT;

a source region of the first TFT is connected to the power supply line and the drain region thereof is connected to a source region of the second TFT;

a drain region of the second TFT is connected to one of two electrodes of the EL element; and a gate electrode of the second TFT is connected to the second gate signal line.

The present invention provides a method of driving a light emitting device that has a plurality of pixels each including a TFT and an EL element,:the method characterized in that:

the TFT is operated in a saturation range;

the amount of current flowing into a channel formation region of the TFT is controlled in accordance with a video signal in a first period;

$V_{GS}$ of the TFT is controlled with the current; and $V_{GS}$ of the TFT is held and a predetermined current flows into the EL element through the TFT in a second period.

The present invention provides a method of driving a light emitting device that has a plurality of pixels each including a TFT and an EL element, the method characterized in that:

the TFT is operated in a saturation range;

the amount of current flowing into a channel formation region of the TFT is controlled in accordance with a video signal in a first period;

$V_{GS}$ of the TFT is controlled with the current; and the current controlled with $V_{GS}$ flows into the EL element through the channel formation region of the TFT in a second period.

The present invention provides a method of driving a light emitting device that has a plurality of pixels each including a first TFT, a second TFT, and an EL element, the method characterized in that:

the first TFT is operated in a saturation range;

the amount of current flowing into a channel formation region of the first TFT is controlled in accordance with a video signal in a first period;

$V_{GS}$ of the first TFT is controlled with the current; and $V_{GS}$ of the first TFT is held and a predetermined current flows into the EL element through the first TFT and the second TFT in a second period.

The present invention provides a method of driving a light emitting device that has a plurality of pixels each including a first TFT, a second TFT, and an EL element, the method characterized in that:

the first TFT is operated in a saturation range;

the amount of current flowing into a channel formation region of the first TFT is controlled in accordance with a video signal in a first period;

$V_{GS}$ of the first TFT is controlled with the current; and the current controlled with $V_{GS}$ flows into the EL element through the channel formation region of the first TFT and the second TFT in a second period.

The present invention provides a method of driving a light emitting device that has a plurality of pixels each including a TFT and an EL element, the method characterized in that:

the TFT is operated in a saturation range;

the amount of current flowing into a channel formation region of the TFT is controlled in accordance with a video signal in a first period;

$V_{GS}$ of the TFT is controlled with the current;

$V_{GS}$ of the TFT is held and a predetermined current flows into the EL element through the TFT in a second period; and no current flows in the EL element in a third period.

The present invention provides a method of driving a light emitting device that has a plurality of pixels each including a TFT and an EL element, the method characterized in that:

the TFT is operated in a saturation range;

the amount of current flowing into a channel formation region of the TFT is controlled in accordance with a video signal in a first period;

$V_{GS}$ of the TFT is controlled with the current;

the current controlled with $V_{GS}$ and flowing through the channel formation region of the TFT flows into the EL element in a second period; and no current flows in the EL element in a third period.

The present invention provides a method of driving a light emitting device that has a plurality of pixels each including a first TFT, a second TFT, and an EL element, the method characterized in that:

the first TFT is operated in a saturation range;

the amount of current flowing into a channel formation region of the first TFT is controlled in accordance with a video signal in a first period;

$V_{GS}$ of the first TFT is controlled with the current;

$V_{GS}$ of the first TFT is held and a predetermined current flows into the EL element through the first TFT and the second TFT in a second period; and the second TFT is turned OFF in a third period.

The present invention provides a method of driving a light emitting device that has a plurality of pixels each including a first TFT, a second TFT, and an EL element, the method characterized in that:

the first TFT is operated in a saturation range;

the amount of current flowing into a channel formation region of the first TFT is controlled in accordance with a video signal in a first period;

$V_{GS}$ of the first TFT is controlled with the current;

the current controlled with $V_{GS}$ and flowing through the channel formation region of the first TFT flows into the EL element through the second TFT in a second period; and the second TFT is turned OFF in a third period.

The present invention provides a method of driving a light emitting device that has a plurality of pixels each including a first TFT, a second TFT, a third TFT, a fourth TFT, and an EL element, the method characterized in that:

in a first period, the third TFT and the fourth TFT connect a gate electrode of the first TFT to a drain region of the first TFT, and the amount of current flowing in a channel formation region of the first TFT is controlled with a video signal;

$V_{GS}$ of the first TFT is controlled with the current; and $V_{GS}$ of the first TFT is held and a predetermined current flows into the EL element through the first TFT in a second period.

The present invention provides a method of driving a light emitting device that has a plurality of pixels each including a first TFT, a second TFT, a third TFT, a fourth TFT, and an EL element, the method characterized in that:

in a first period, the third TFT and the fourth TFT connect a gate electrode of the first TFT to a drain region of the first TFT, and the amount of current flowing in a channel formation region of the first TFT is controlled with a video signal;

$V_{GS}$ of the first TFT is controlled with the current; and the current controlled with $V_{GS}$ flows into the EL element through the channel formation region of the first TFT and the second TFT in a second period.

The present invention provides a method of driving a light emitting device that has a plurality of pixels each including a first TFT, a second TFT, a third TFT, a fourth TFT, and an EL element, the method characterized in that:

a given electric potential is supplied to a source region of the first TFT;

a video signal is inputted to a gate electrode of the first TFT and a drain region thereof through the third TFT and the fourth TFT in a first period; and a predetermined current flows into the EL element in accordance with the electric potential of the video signal through the first TFT and the second TFT in a second period.

The present invention provides a method of driving a light emitting device that has a plurality of pixels each including a first TFT, a second TFT a third TFT, a fourth TFT, and an EL element, the method characterized in that:

in a first period, the third TFT and the fourth TFT connect a gate electrode of the first TFT to a drain region of the first TFT, and the amount of current flowing in a channel formation region of the first TFT is controlled with a video signal;

$V_{GS}$ of the first TFT is controlled with the current;

$V_{GS}$ of the first TFT is held and a predetermined current flows into the EL element through the first TFT in a second period; and the second TFT is turned OFF in a third period.

The present invention provides a method of driving a light emitting device that has a plurality of pixels each including a first TFT, a second TFT, a third TFT, a fourth TFT, and an EL element, the method characterized in that:

in a first period, the third TFT and the fourth TFT connect a gate electrode of the first TFT to a drain region of the first TFT, and the amount of current flowing in a channel formation region of the first TFT is controlled with a video signal;

$V_{GS}$ of the first TFT is controlled with the current;

the current controlled with $V_{GS}$ and flowing through the channel formation region of the first TFT flows into the EL element through the second TFT in a second period; and the second TFT is turned OFF in a third period.

The present invention provides a method of driving a light emitting device that has a plurality of pixels each including a first TFT, a second TFT, a third TFT, a fourth TFT, and an EL element, the method characterized in that:

a given electric potential is supplied to a source region of the first TFT;

a video signal is inputted to a gate electrode of the first TFT and a drain region thereof through the third TFT and the fourth TFT in a first period;

a predetermined current flows into the EL element in accordance with the electric potential of the video signal through the first TFT and the second TFT in a second period; and the second TFT is turned OFF in a third period.

The present invention may be characterized in that the third TFT and the fourth TFT have the same polarity.

DETAILED DESCRIPTION OF THE PREFERRED EMBODIMENTS

Embodiment Mode 1

Figure 1:
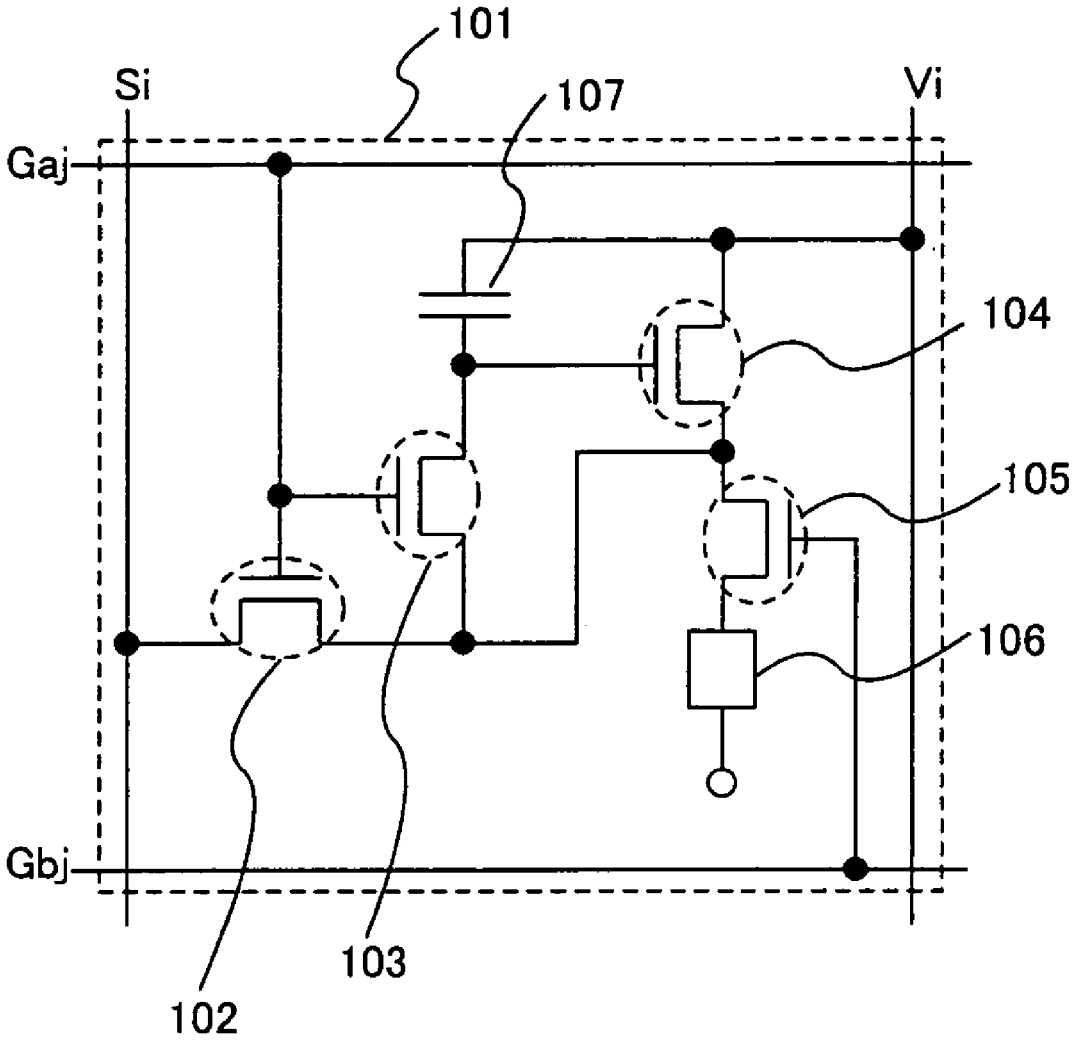
FIG. 1 is a circuit diagram of a pixel of a light emitting device according to the present invention.

FIG. 1 shows the structure of a pixel according to the present invention.

A pixel 101 shown in FIG. 1 has a source signal line Si (one of source signal lines S1 to Sx), a writing gate signal line Gaj (one of writing gate signal lines Ga1 to Gay), a display gate signal line Gbi (one of display gate signal lines Gb1 to Gby), and a power supply line Vi (one of power supply lines V1 to Vx).

The number of source signal lines and the number of power supply lines are not necessarily the same. The number of writing gate signal lines and the number of display gate signal lines are not necessarily the same. The pixel may not always have all of the above wiring lines, and may have different kinds of wiring lines in addition to the above wiring lines.

The pixel 101 also have a first switching TFT 102, a second switching TFT 103, a current controlling TFT 104, an EL driving TFT 105, an EL element 106, and a capacitor 107.

The first switching TFT 102 and the second switching TFT 103 are both connected to the writing gate signal line Gaj at their gate electrodes.

Note that 'connection' in this specification refers to electric connection unless otherwise stated.

The first switching TFT 102 has a source region and a drain region one of which is connected to the source signal line Si and the other of which is connected to a source region of the EL driving TFT 105. The second switching TFT 103 has a source region and a drain region one of which is connected to the source region of the EL driving TFT 105 and the other of which is connected to a gate electrode of the current controlling TFT 104.

In other words, one of the source region and the drain region of the first switching TFT 102 is connected to one of the source region and the drain region of the second switching TFT 103.

The current controlling TFT 104 has a source region connected to the power supply line Vi and has a drain region connected to the source region of the EL driving TFT 105.

In this specification, a voltage given to a source region of an n-channel transistor is lower than a voltage given to a drain region thereof. On the other hand, a voltage given to a source region of a p-channel transistor is higher than a voltage given to a drain region thereof.

A gate electrode of the EL driving TFT 105 is connected to the display gate signal line Gbj. A drain region of the EL driving TFT 105 is connected to a pixel electrode of the EL element 106. The EL element 106 has the pixel electrode, an opposite electrode, and an EL layer placed between the pixel electrode and the opposite electrode. The opposite electrode of the EL element 106 is connected to a power supply provided outside of the EL panel (a power supply for opposite electrode).

The level of the electric potential of the power supply line Vi (power supply electric potential) is kept constant. The level of the electric potential of the power supply for opposite electrode is kept constant as well.

The first switching TFT 102 and the second switching TFT 103 may either be n-channel TFTs or p-channel TFTs. However, the first switching TFT 102 and the second switching TFT 103 must have the same polarity.

The current controlling TFT 104 may either be an n-channel TFT or a p-channel TFT.

The EL driving TFT 105 may either be an n-channel TFT or a p-channel TFT. One of the pixel electrode and the opposite electrode of the EL element serves as an anode whereas the other serves as a cathode. When the pixel electrode serves as the anode and the opposite electrode serves as the cathode, the EL driving TFT 105 is preferably a p-channel TFT. On the other hand, an n-channel TFT is preferable for the EL driving TFT 105 when the opposite electrode serves as the anode and the pixel electrode serves as the cathode.

The capacitor 107 is formed between the gate electrode of the current controlling TFT 104 and the source region thereof. The capacitor 107 is provided to maintain the voltage between the gate electrode of the current controlling TFT 104 and the source region thereof (the voltage is denoted by $V_{GS}$) more securely during the first and second switching TFTs 102 and 103 are turned OFF, but it may be omitted.

Figure 2:
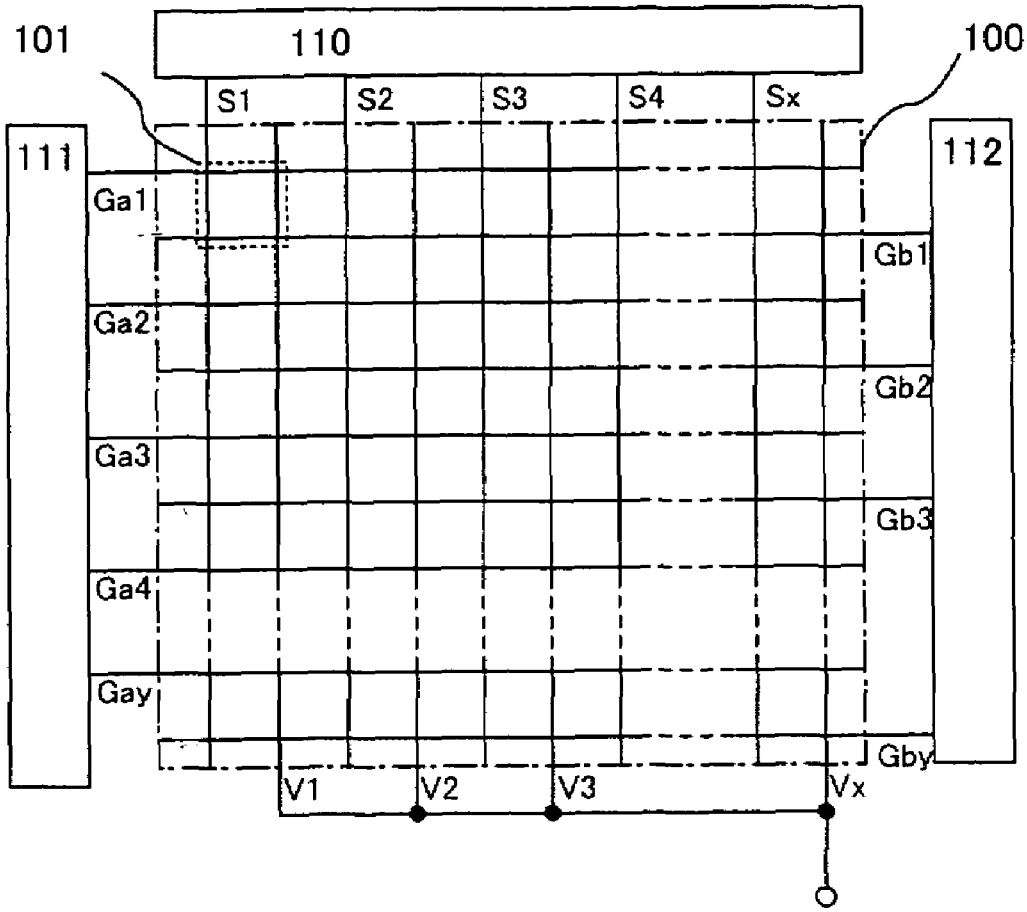
FIG. 2 is a block diagram showing a top view of a light emitting device according to the present invention.

FIG. 2 is a block diagram showing a light emitting device to which a driving method of the present invention is applied. Reference symbol 100 denotes a pixel portion, 110, a source signal line driving circuit, 111, a writing gate signal line driving circuit, and 112, a display gate signal line driving circuit.

The pixel portion 100 has the source signal lines SI to Sx, the writing gate signal lines Ga1 to Gay, the display gate signal lines Gb1 to Gby, and the power supply lines V1 to Vx.

A region having one source signal line, one writing gate signal line, one display gate signal line, and one power supply line corresponds to the pixel 101. The pixel portion 100 has a plurality of such regions and the regions form a matrix.

Embodiment Mode 2

Described in this embodiment mode is driving of the light emitting device shown in FIGS. 1 and 2 in accordance with the present invention. The description will be given with reference to FIGS. 3A and 3B. The driving of the light emitting device according to the present invention can be divided into driving in a writing period Ta and driving in a display period Td.

Figure 3A:
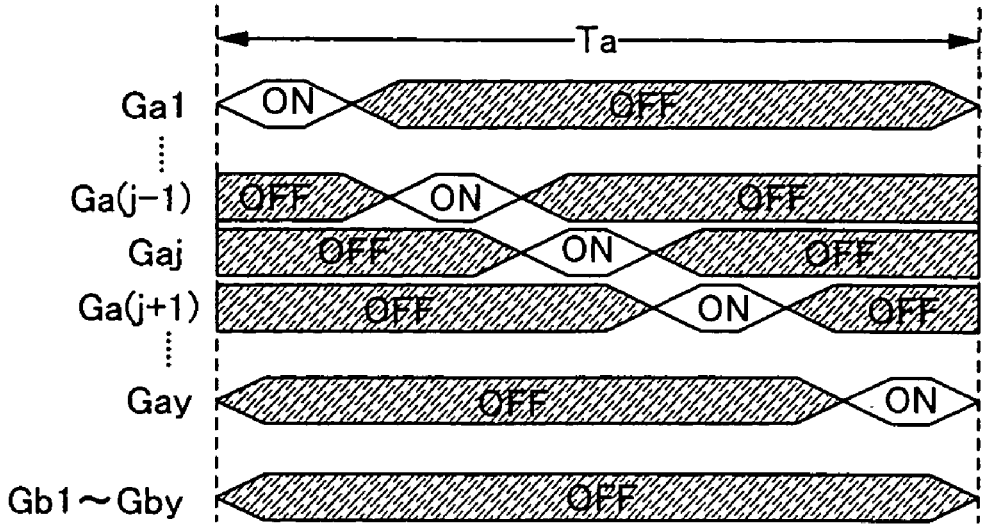
FIGS. 3A and 3B are timing charts of signals inputted to writing gate signal lines and display gate signal lines.

FIG. 3A is a timing chart of signals inputted in writing gate signal lines and display gate signal lines during the writing period Ta. Periods during which writing gate signal lines and display gate signal lines are selected, in other words, periods in which all of TFTs whose gate electrodes are connected to those signal lines are in an ON state, are indicated by 'ON' in FIG. 3A. On the other hand, 'OFF' indicates periods during which writing gate signal lines and display gate signal lines are not selected, in other words, periods in which all of TFTs whose gate electrodes are connected to those signal lines are in an OFF state.

In the writing period Ta, the writing gate signal lines Ga1 to Gay are selected in order whereas the display gate signal lines Gb1 to Gby are not selected. Whether or not a constant current Ic flows into the respective source signal lines S1 to Sx is determined by digital video signals inputted to the source signal line driving circuit 110.

Figure 4A:
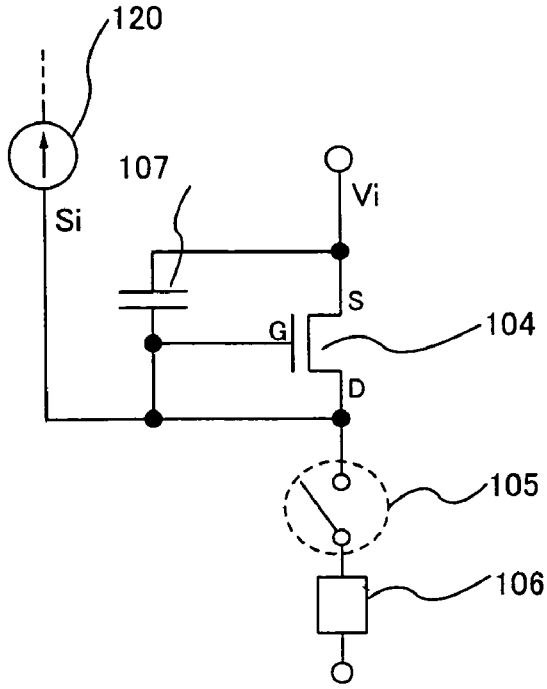
FIGS. 4A and 4B are schematic diagrams of a pixel being driven.

FIG. 4A is a schematic diagram of a pixel when the constant current Ic flows into the source signal line Si during the writing period Ta. Since the first switching TFT 102 and the second switching TFT 103 are in an ON state, when the source signal line Si receives the constant current Ic, the constant current Ic flows between the drain region and the source region of the current controlling TFT 104.

The source region of the current controlling TFT 104 is connected to the power supply line Vi and is kept at a certain electric potential (power supply electric potential).

The current controlling TFT 104 is operated in the saturation range, and $V_{GS}$ is therefore logically obtained by substituting Ic for IDS in Equation 2.

If the constant current Ic does not flow into the source signal line Si, the source signal line Si is kept at the same electric potential as the power supply line Vi. In this case, $V_{GS} \approx 0$.

When the writing period Ta is ended, the display period Td is started.

Figure 3B:
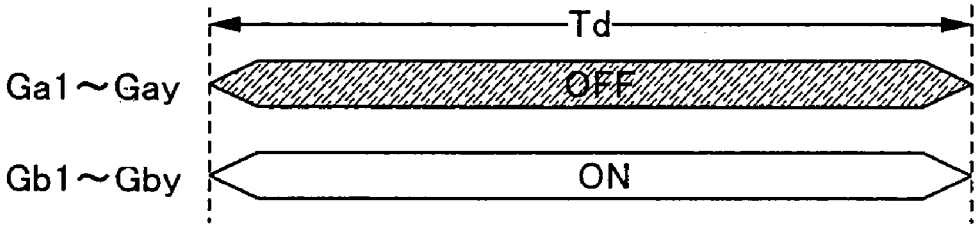

FIG. 3B is a timing chart of signals inputted to writing gate signal lines and display gate signal lines during the display period Td.

In the display period Td, none of the writing gate signal lines Ga1 to Gay is selected whereas the display period gate signal lines Gb1 to Gby are all selected.

Figure 4B:
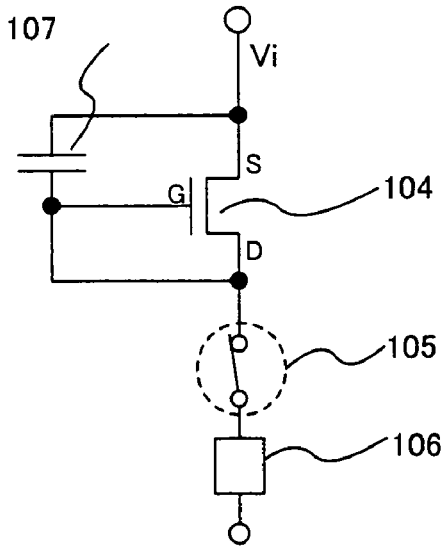

FIG. 4B is a schematic diagram of a pixel in the display period Td. The first switching TFT 102 and the second switching TFT 103 are in an OFF state. The source region of the current controlling TFT 104 is connected to the power supply line Vi and is kept at a certain electric potential (power supply electric potential).

$V_{GS}$ set in the writing period Ta is maintained during the display period Td. Accordingly, $I_{DS}$ is logically obtained by inputting $V_{GS}$ to Equation 2.

Since $V_{GS} \approx 0$ when the constant current Ic does not flow in the writing period Ta, there is no current flow if the threshold is 0. Then the EL element 106 does not emit light.

When the constant current Ic flows during the writing period Ta, $V_{GS}$ is inputted to Equation 2 to obtain Ic as the current value $I_{DS}$. In the display period Td, the EL driving TFT 105 is turned ON to cause the current Ic to flow in the EL element 106, which then emits light.

The writing period Ta and the display period Td are repeatedly alternated in one frame period as described above, whereby one image is displayed. In the case where n bit digital video signals are used to display an image, at least n writing periods and n display periods are provided in one frame period.

A writing period Ta1 and a display period Td1 are for a 1 bit digital video signal, a writing period Ta2 and a display period Td2 are for a 2 bit digital signal, and a writing period Tan and a display period Tdn are for a n bit digital video signal.

Figure 5:
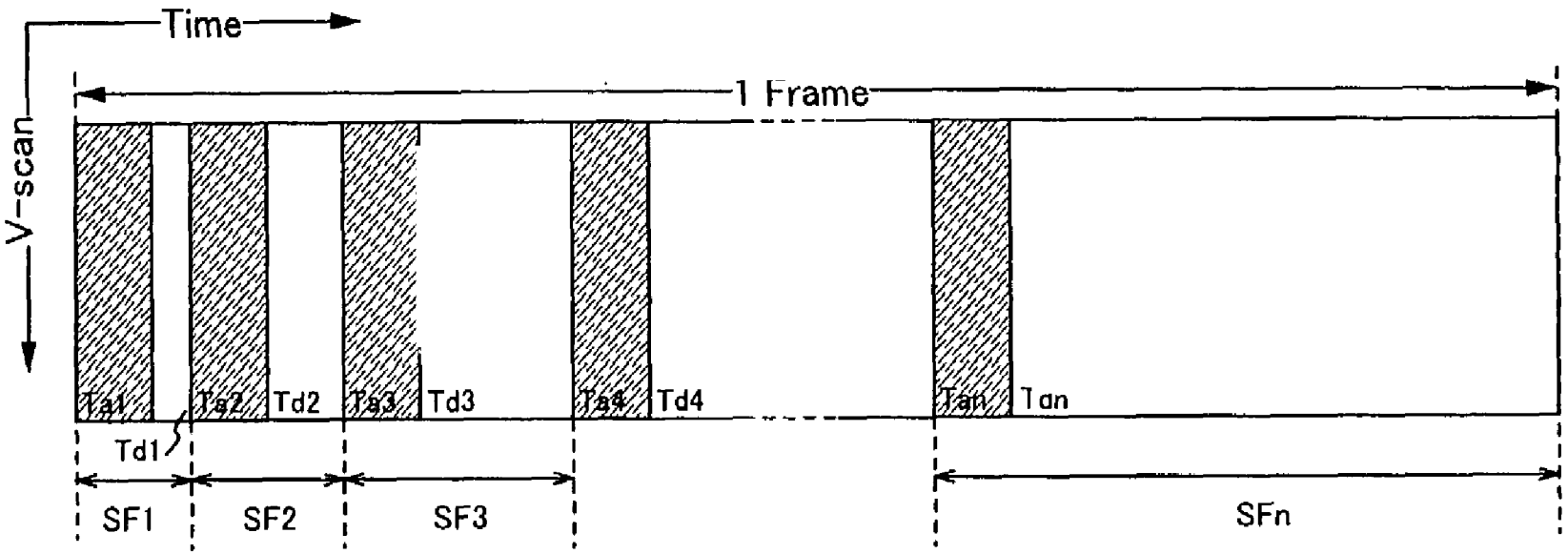
FIG. 5 is a timing diagram of writing periods and display periods.

FIG. 5 is a timing diagram of n writing periods (Ta1 to Tan) and n display periods (Td1 to Tdn) in one frame period. The horizontal axis indicates time and the vertical axis indicates the position of writing gate signal lines and display gate signal lines of pixels.

A writing period Tam (m is an arbitrary number ranging from 1 to n) is followed by a display period that is for the digital video signal of the same bit, in this case, a display period Tdm. One writing period Ta and one display period Td constitute a sub-frame period SF. The writing period Tam and the display period Tdm that are for an m bit digital video signal make a sub-frame period SFm.

The length of the display periods Td1 to Tdn is set so as to satisfy Td1:Td2: . . . :Tdn=$2^0$:$2^1$: . . . :$2^{n-1}$.

According to the driving method of the present invention, gray scale display is obtained by controlling the total light emission time of a pixel in one frame period. With the above structure, the light emitting device of the present invention can obtain a luminance of constant level irrespective of temperature change. Furthermore, if different EL materials are used in EL elements of different colors in order to display in color, temperature change does not cause varying degrees of changes in luminance between the EL elements of different colors and a failure to obtain desired colors is thus avoided.

Embodiment Mode 3

The light emitting device shown in FIGS. 1 and 2 in accordance with the present invention can be driven by a driving method different from the one described in Embodiment Mode 2. This driving method will be explained with reference to FIGS. 6 to 9.

First, the writing period Ta1 is started in pixels on Line One.

In the writing period Ta1, a first selection signal (writing selection signal) is inputted from the writing gate signal line driving circuit 111 to the writing gate signal line Ga1, so that the writing gate signal line Ga1 is selected. A signal line being selected means in this specification that TFTs whose gate electrodes are connected to that signal line are all brought into an ON state. Then the first switching TFT 102 and the second switching TFT 103 are turned ON in each of the pixels that have the writing gate signal line Ga1 (the pixels on Line One).

The display gate signal line Gb1 of the pixels on Line One is not selected during the writing period Ta1. Therefore every EL driving TFT 105 in the pixels on Line One is in an OFF state.

A 1 bit digital video signal is inputted to the source signal line driving circuit 110 and determines how much current flows into the source signal lines S1 to Sx.

Digital video signals contain information, which is '0' or '1'. A digital video signal carrying '0' is a signal having Lo (Low) voltage whereas a digital video signal carrying '1' is a signal having Hi (High) voltage, or '0' is Hi signal whereas '1' is Lo signal. Information contained in a digital video signal, '0' or '1', is used to control the drain current flowing in the current controlling TFT 104.

Specifically, which information of '0' and '1' a digital video signal carries determines whether or not the constant current Ic flows between the power supply line Vi and the source signal line Si through the current controlling TFT 104, the first switching TFT 102, and the second switching TFT 103.

In this specification, input of a video signal to a pixel means that whether or not the constant current Ic flows between the power supply line Vi and the source signal line Si is determined.

Figure 8A:
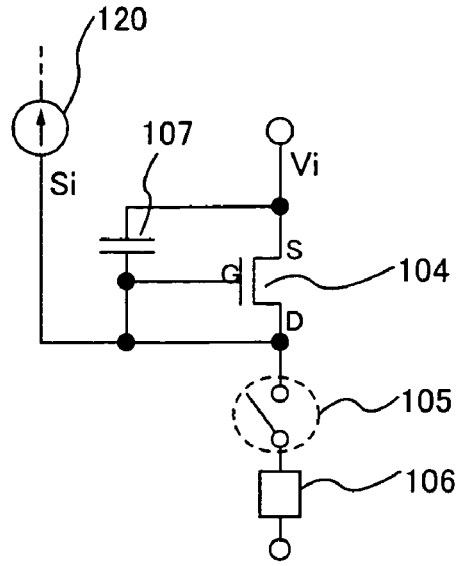
FIGS. 8A to 8C are schematic diagrams of a pixel being driven.

FIG. 8A is a schematic diagram of a pixel in the writing period Ta1.

During the writing period Ta1, the writing gate signal line Ga1 is selected whereas the display gate signal line Gb1 is not selected. Since the first switching TFT 102 and the second switching TFT 103 are turned ON, when the source signal line Si receives the constant current Ic, the constant current Ic flows between the drain region and the source region of the current controlling TFT. At this point, the EL driving TFT 105 is in an OFF state. Therefore the electric potential of the power supply line Vi is not given to the pixel electrode of the EL element 106 and the EL element 106 does not emit light.

The source region of the current controlling TFT 104 is connected to the power supply line Vi and is kept at a certain electric potential (power supply electric potential). The current controlling TFT 104 is operated in the saturation range, and $V_{GS}$ of the current controlling TFT 104 is therefore logically obtained by substituting Ic for $I_{DS}$ in Equation 2.

If the constant current Ic does not flow into the source signal line Si, the source signal line Si is kept at the same electric potential as the power supply line Vi. In this case, $V_{GS} \approx 0$ in the current controlling TFT 104.

When the writing gate signal line Ga1 is no longer selected, the writing period Ta1 is ended in the pixels on Line One.

Completion of the writing period Ta1 in the pixels on Line One is followed by start of the writing period Ta1 in the pixels on Line Two. A writing selection signal is inputted to select the writing gate signal Ga2, and the same operation that the pixels on Line One have conducted is performed. Thereafter the writing gate signal lines Ga3 to Gay are selected in order, so that all pixels undergo the writing period Ta1 and the same operation as the pixels on Line One.

At which point the writing period Ta1 comes up varies between pixels on a line and pixels on another line, and the length of the writing period Ta1 corresponds to the length of the period during which a writing gate signal line of pixels on a line is selected. Starting points of the writing period Ta1 are staggered for pixels on a line and pixels on another line, and the same applies to the writing periods Ta2 to Tan.

While the writing period Ta1 is started in the pixels on Line Two and then in pixels on the subsequent lines after the writing period Ta1 is ended in the pixels on Line One, a display period Tr1 is started in the pixels on Line One.

In the display period Tr1, a second selection signal (display selection signal) is inputted from the display gate signal line driving circuit 112 to the display gate signal line Gb1 to select the display gate signal line Gb1. Selecting the display gate signal line Gb1 is started before selecting the writing gate signal lines Ga2 to Gay is completed. Preferably, selecting the display gate signal line Gb1 is started at the same time selecting the writing gate signal line Ga2 is started after the selection period of the writing gate signal line Ga1 is ended.

Figure 8B:
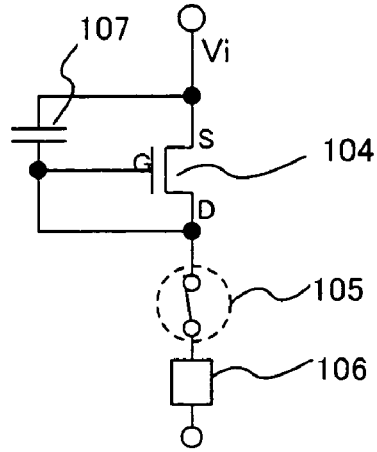

FIG. 8B is a schematic diagram of a pixel during the display period Tr1.

In the display period Tr1, the writing gate signal line Ga1 is not selected whereas the display gate signal line Gb1 is selected. Accordingly, the first switching TFT 102 and the second switching TFT 103 are turned OFF while the EL driving TFT is turned ON in each of the pixels on Line One.

The source region of the current controlling TFT 104 is connected to the power supply line Vi and is kept at a certain electric potential (power supply electric potential). $V_{GS}$ of the current controlling TFT 104, which has been set in the writing period Ta1, is maintained by the capacitor 107 or the like when the writing gate signal line Ga1 is no longer selected. The current $I_{DS}$ flowing between the source region and the drain region of the current controlling TFT 104 at this point is obtained by inputting $V_{GS}$ to Equation 2. The current $I_{DS}$ flows into the EL element 106 through the EL driving TFT 105 that is turned ON, and the EL element 106 emits light as a result.

$V_{GS}\approx 0$ in the current controlling TFT 104 if the current Ic does not flow while the writing gate signal line Ga1 is selected. Accordingly, there is no current flow between the source region and the drain region of the current controlling TFT 104 and the EL element 106 does not emit light.

In this way, a digital video signal is inputted to pixels and then a display gate signal line is selected to determine whether the EL element 106 emits light or not. An image is thus displayed with pixels.

After the display period Tr1 is started in the pixels on Line One, the display period Tr1 is started in the pixels on Line Two as well. A display selection signal selects the display gate signal line Gb2, and the same operation that the pixels on Line One have conducted is performed. Thereafter the display gate signal lines Ga3 to Gby are selected in order, so that all pixels undergo the display period Tr1 and the same operation as the pixels on Line One.

The display period Tr1 for pixels on a line corresponds to the period during which a display gate signal line of the pixels on that line is selected. Starting points of the display period Tr1 are staggered for pixels on a line and pixels on another line, and the same applies to display periods Tr2 to Trn.

While the display period Tr1 is started in the pixels on Line Two and in pixels on the subsequent lines, selecting the display gate signal line Gb1 is ended to complete the display period Tr1 in the pixels on Line One.

In the pixels on Line One, a non-display period Td1 is started upon completion of the display period Tr1. The display gate signal line Gb1 is no longer selected and every EL driving TFT 105 in the pixels on Line One is turned OFF. At this point, the writing gate signal line Ga1 remains unselected.

Since the EL driving TFT 105 in each of the pixels on Line One is in an OFF state, the power supply electric potential of the power supply line Vi is not given to the pixel electrode of the EL element 106. Therefore no EL element 106 in the pixels on Line One emits light and the pixels on Line One are not lit up for display.

Figure 8C:
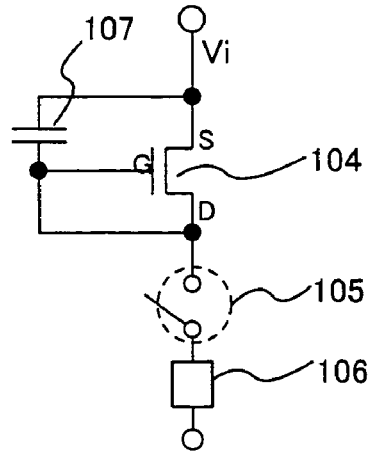

FIG. 8C is a schematic diagram of one of the pixels on Line One when the display gate signal line Gb1 and the writing gate signal line Ga1 are not selected. The first switching TFT 102 and the second switching TFT 103 are turned OFF and the EL driving TFT 105 is also turned OFF The EL element 106 therefore doe not emit light.

After the non-display period Td1 is started in the pixels on Line One, the display period Tr1 is ended and the non-display period Td1 is started in the pixels on Line Two as well. A display selection signal selects the display gate signal line Gb2, and the same operation that the pixels on Line One have conducted is performed by the pixels on Line Two. Thereafter the display gate signal lines Gb3 to Gby are selected in order, so that the display period Tr1 is completed and the non-display period Td1 is started to carry out the same operation as the pixels on Line One in the entire pixels.

Starting points of the non-display period Td1 are staggered for pixels on a line and pixels on another line. The non-display period Td1 for pixels on a line corresponds to the period during which a writing gate signal line is not selected and a display gate signal line is selected in the pixels on that line.

While the non-display period Td1 is started in the pixels on Line Two and in pixels on the subsequent lines, or after the non-display period Td1 is started in all pixels, selecting the writing gate signal line Ga2 is started to begin the writing period Ta2 in the pixels on Line One.

A writing period of pixels on a line does not overlap a writing period of pixels on another line in the present invention. Therefore a writing period of the pixels on Line One is started after a writing period is ended in pixels on Line Y.

The pixels operate here in the same way they do in the writing period Ta1, except that a 2 bit digital video signal is inputted to the pixels in the writing period Ta2.

After the writing period Ta2 is ended in the pixels on Line One, the writing period Ta2 is started in the pixels on Line Two and then in pixels on the subsequent lines in order.

While the writing period Ta2 is started in the pixels on Line Two and in pixels on the subsequent lines, the display period Tr2 is started in the pixels on Line One. Similarly to the display period Tr1, the pixels are lit up for display in accordance with a 2 bit digital video signal in the display period Tr2.

After the display period Tr2 is started in the pixels on Line One, the writing period Ta2 is ended and the display period Tr2 is started in the pixels on Line Two and in pixels on the subsequent lines in order. In this way, pixels on the respective lines are lit up for display.

While the display period Tr2 is started in the pixels on Line Two and in pixels on the subsequent lines, the display period Tr2 is ended and the non-display period Td2 is started in the pixels on Line One. When the non-display period Td2 is started, the pixels on Line One are no longer lit up for display.

After the non-display period Td2 is started in the pixels on Line One, the display period Tr2 is ended and the non-display period Td2 is started in the pixels on Line Two and in pixels on the subsequent lines in order. When the non-display period Td2 is started, pixels on the respective lines are no longer lit up for display.

The operation described above is repeated until it is time to input an m bit digital video signal to pixels. During the operation, the writing period Ta, the display period Tr, and the non-display period Td repeatedly take turns in pixels on each line.

Figure 6:
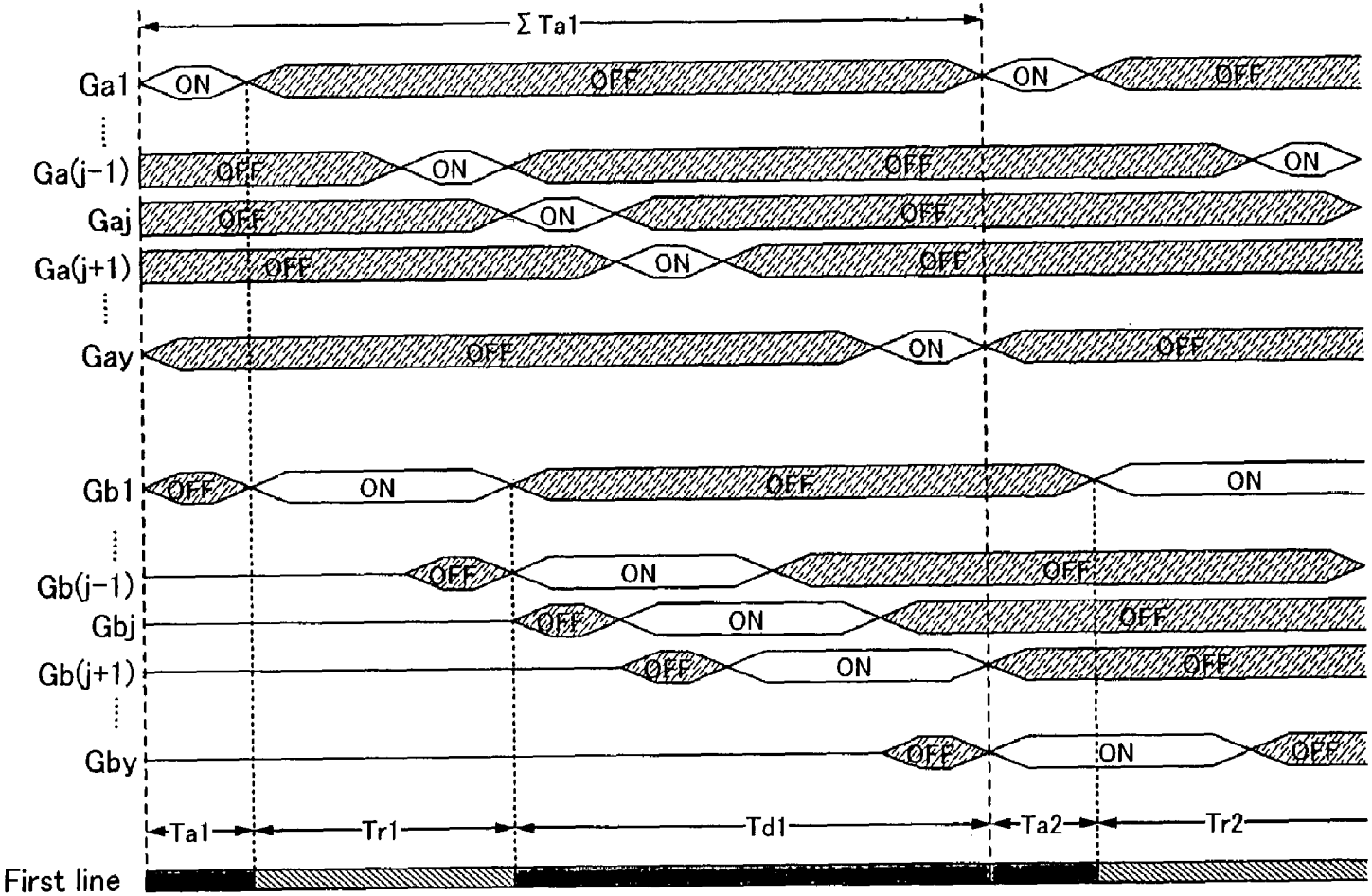
FIG. 6 is a timing chart of signals inputted to writing gate signal lines and display gate signal lines.

FIG. 6 shows selection of the writing gate signal lines Ga1 to Gay and selection of the display gate signal lines Gb1 to Gby in relation to one another in the writing period Ta1, the display period Tr1, and the non-display period Td1.

Focusing attention on the pixels on Line One, for example, the pixels are not lit up for display in the writing period Ta1 and the non-display period Td1. The pixels on Line One are lit up for display only in the display period Tr1. FIG. 6 exemplarily shows the operation of pixels in the writing period Ta1, the display period Tr1, and the non-display period Td1 in order to explain the operation of pixels in the writing periods Ta1 to Ta(m−1), the display periods Tr1 to Tr(m−1), and the non-display periods Td1 to Td(m−1). Accordingly, pixels on every line are not lit up for display in the writing periods Ta1 to Ta(m−1) and the non-display periods Td1 to Td(m−1) whereas pixels on every line are lit up for display in the display periods Tr1 to Tr(m−1).

Described next is the operation of pixels after the writing period Tam in which a m bit digital video signal is inputted to pixels is started. The symbol m in the present invention stands for a number arbitrary selected from 1 through n.

As the writing period Tam is started in the pixels on Line One, an m bit digital video signal is inputted to the pixels on Line One. When the writing period Tam is ended in the pixels on Line One, the writing period Tam is started in the pixels on Line Two and in pixels on the subsequent lines in order.

While the writing period Tam is started in the pixels on Line Two and in pixels on the subsequent lines after the writing period Tam is ended in the pixels on Line One, the display period Trm is started in the pixels on Line One. The pixels are lit up for display in accordance with an m bit digital video signal in the display period Trm.

After the display period Trm is started in the pixels on Line One, the writing period Tam is ended and the display period Trn is started in the pixels on Line Two and in pixels on the subsequent lines in order.

The display period Trm is ended and a writing period Ta(m+1) is started in the pixels on Line One after the display period Trm is started in the pixels on the rest of the lines.

As the writing period Ta(m+1) is started in the pixels on Line One, a (m+1) bit digital video signal is inputted to the pixels on Line One.

Then the writing period Ta(m+1) is ended in the pixels on Line One. After the writing period Ta(m+1) is ended in the pixels on Line One, the display period Trm is ended and the writing period Ta(m+1) is started in the pixels on Line Two and in pixels on the subsequent lines in order.

The operation described above is repeated until the display period Tm for an n bit digital video signal is ended in the pixels on the last line, namely, Line Y, so that the writing period Ta and the display period Tr repeatedly take turns in pixels on each line.

Figure 7:
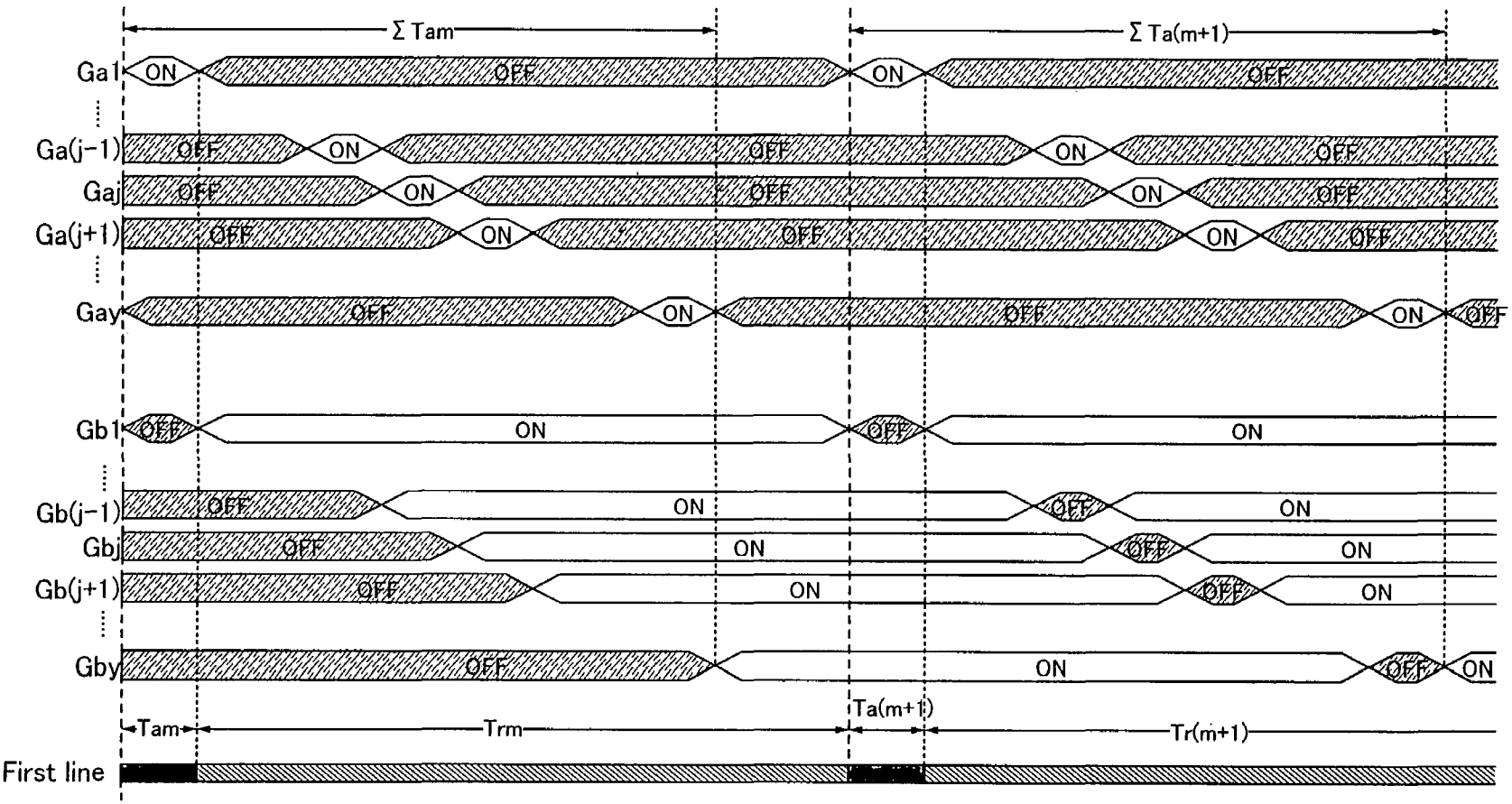
FIG. 7 is a timing chart of signals inputted to writing gate signal lines and display gate signal lines.

FIG. 7 shows selection of the writing gate signal lines Ga1 to Gay and selection of the display gate signal lines Gb1 to Gby in relation to one another in the writing period Tam and the display period Trm.

Focusing attention on the pixels on Line One, for example, the pixels are not lit up for display in the writing period Tam. The pixels on Line One are lit up for display only in the display period Trm. FIG. 7 exemplarily shows the operation of pixels in the writing period Tam and the display period Trm in order to explain the operation of pixels in the writing periods Tam to Tan and the display periods Trm to Tm. Accordingly, pixels on every line are not lit up for display in the writing periods Tam to Tan whereas pixels on every line are lit up for display in the display periods Trm to Tm.

Figure 9:
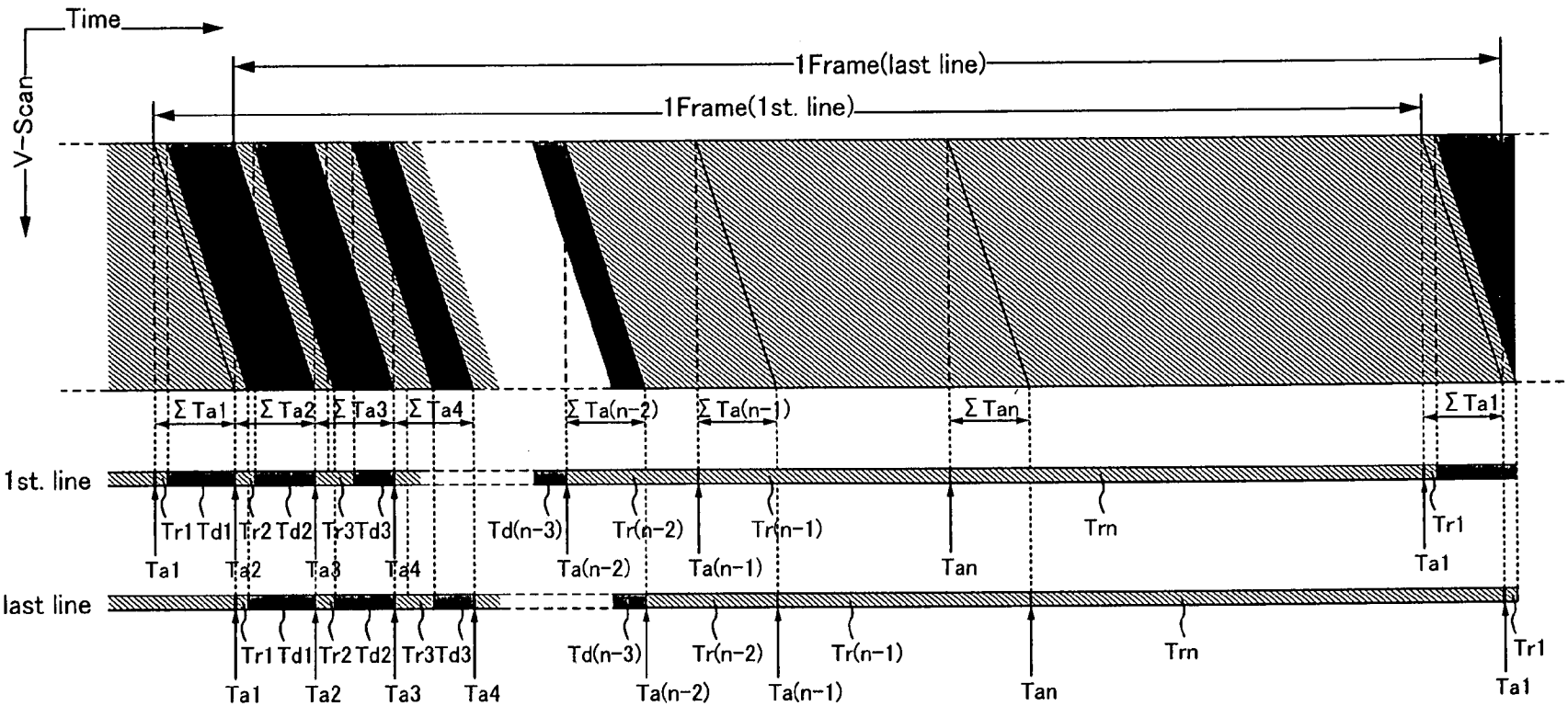
FIG. 9 is a timing diagram of writing periods, display periods, and non-display periods.

FIG. 9 is a timing diagram of writing periods, display periods, and non-display periods when m=n−2 in the driving method of the present invention. The horizontal axis indicates time and the vertical axis indicates the position of writing gate signal lines and display gate signal lines of pixels. The writing periods are not shown as bands in FIG. 9 because they are short. Instead, for less crowded view, arrows indicate starting points of the writing periods Ta1 to Tan for 1 to n bit digital video signals. A period that begins with the start of a writing period in the pixels on Line One and ends with the end of a writing period in the pixels on Line Y for a 1 bit digital video signal is denoted by ΣTa1 and indicated by an arrow. 2 to n bit digital video signals have similar periods, ΣTa2 to ΣTan, indicated by arrows.

Upon completion of Trn in the pixels on Line One, one frame period is ended. Then the writing period Ta1 is again started in the pixels on Line One for the next frame period. The operation described above is repeated again. The starting point and the ending point of one frame period for pixels on a line is different from the starting point and the ending point of one frame period for pixels on another line.

When one frame period is completed for the pixels on all the lines, one image is displayed.

A preferred light emitting device has 60 or more frame periods in one second. If the number of images displayed per second is less than 60, flickering of images may be noticeable to the eye.

In the present invention, the sum of lengths of all the writing periods for pixels on each line is shorter than the length of one frame period. Also, the length of the display periods is set so as to satisfy Tr1:Tr2:Tr3: . . . :Tr(n−1): Trn=$2^0$:$2^1$:$2^2$:$2^{(n-2)}$: $2^{(n-1)}$. By changing the combination of the display periods during which light is emitted from a pixel, the pixel can obtain a desired gray scale within $2^n$ gray scales.

The total length of display periods during which an EL element emits light in one frame period determines the gray scale of the pixel having that EL element in that particular frame period. For example, n=8 and the luminance of a pixel that is lit up for all display periods is 100%. Then if a pixel is lit up in Tr1 and Tr2, the luminance of the pixel is 1%. If a pixel is lit up in Tr3, Tr5, and Tr8, the luminance of the pixel is 60%.

The length of the display period Trm has to be longer than the period that begins with the start of the writing period Tam in the pixels on Line One and ends with the end of the writing period Tam in the pixels on Line Y (ΣTam).

The display periods Tr1 to Trn may be run in random order. For example, Tr3, Tr5, Tr2, . . . may follow Tr1 in the order stated in one frame period. However, a writing period of pixels on a line should not overlap a writing period of pixels on another line.

Although a capacitor is provided in order to hold the voltage applied to the gate electrode of the EL driving TFT in this embodiment, the capacitor may be omitted. If the EL driving TFT has an LDD region that overlaps the gate electrode with a gate insulating film interposed therebetween, a parasitic capacitance generally called a gate capacitance is formed in the overlap region. This gate capacitance can be put into an active role as a capacitor for holding the voltage applied to the gate electrode of the EL driving TFT.

The gate capacitance varies depending on the area of the overlap region where the LDD region overlaps the gate electrode, and therefore is determined by the length of a part of the LDD region that is in the overlap region.

In the driving method of this embodiment mode, the length of the display period of pixels on any line can be shorter than the period that begins with the start of the writing period Ta of the pixels on Line One and ends with the end of the writing period Ta of the pixels on Line Y, namely, the period required for writing one bit digital video signal in all pixels. Accordingly, if the bit number of digital video signals is increased, the length of the display period for a digital video signal of less significant bit can be reduced, whereby a high definition image can be displayed without flicker on the screen.

The light emitting device of the present invention can obtain a constant level of luminance irrespective of temperature change. Furthermore, if different EL materials are used in EL elements of different colors in order to display in color, temperature change does not cause varying degrees of changes in luminance between the EL elements of different colors and a failure to obtain desired colors is thus avoided.

The driving methods described in Embodiment Modes 1 and 2 use digital video signals to display an image but analog video signals may be used instead. When analog video signals are used to display an image, the current flowing into source signal lines is controlled with the analog video signals. Gray scales of pixels are varied through this control of the current amount, thereby obtaining gray scale display.

The following is a description of Embodiments of the present invention.

Embodiment 1

This embodiment describes in what order the sub-frame periods SF1 to SFn are run in the driving method of Embodiment Mode 1 for n bit digital video signals.

Figure 10:
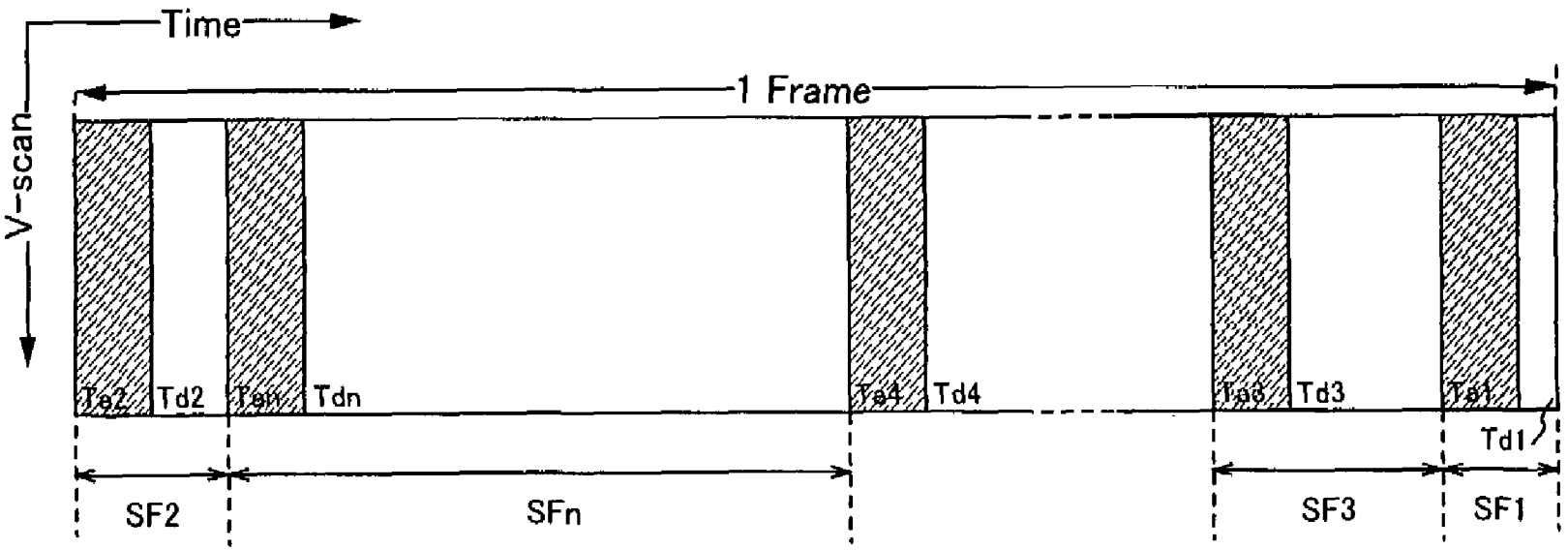
FIG. 10 is a timing chart of signals inputted to writing gate signal lines and display gate signal lines.

FIG. 10 is a timing diagram of n writing periods (Ta1 to Tan) and n display periods (Td1 to Tdn) in one frame period. The horizontal axis indicates time and the vertical axis indicates the position of writing gate signal lines and display gate signal lines of pixels. Details about how pixels are driven are described in Embodiment Mode 1 and the explanation is therefore omitted here.

According to the driving method of this embodiment, the sub-frame period having the longest display period in one frame period (SFn, in this embodiment) does not come first or last in the one frame period. In other words, the sub-frame period having the longest display period in one frame period is sandwiched between other sub-frame periods of the same frame period.

The above structure makes the uneven display in middle gray scale display less recognizable to the human eye. The uneven display is caused by adjoining display periods during which light is emitted from pixels in adjacent frame periods.

The structure of this embodiment is effective when $n \geqq 3$.

Embodiment 2

This embodiment describes a case of using 6 bit digital video signals in the driving method of Embodiment Mode 1.

Figure 11:
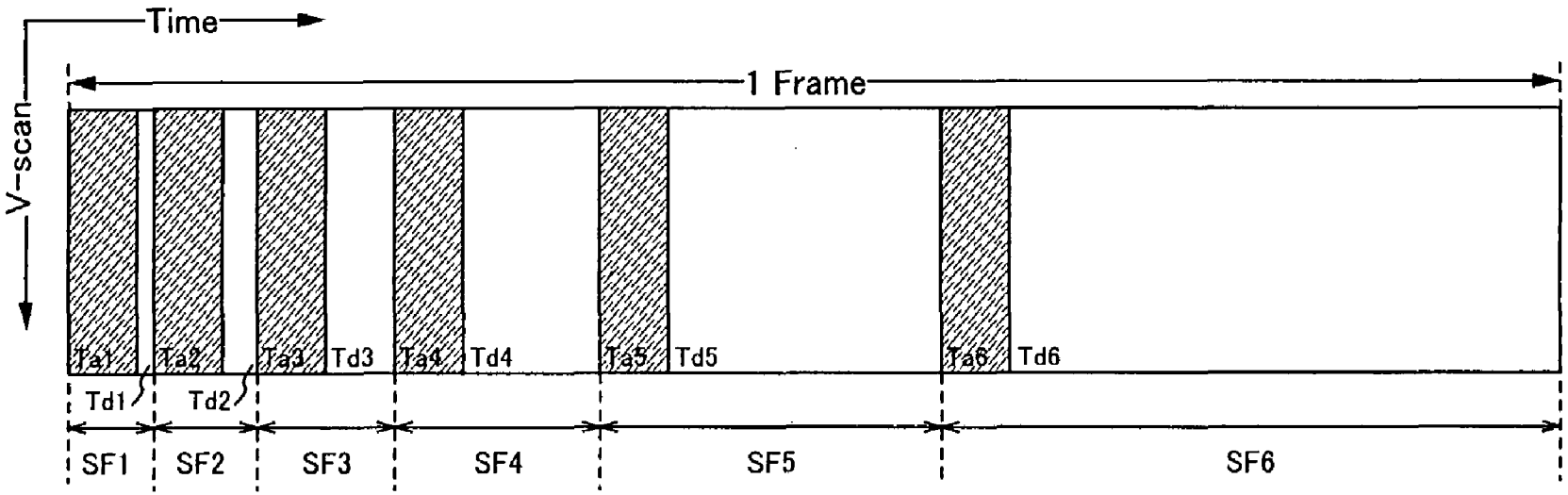
FIG. 11 is a timing chart of signals inputted to writing gate signal lines and display gate signal lines.

FIG. 11 is a timing diagram of n writing periods (Ta1 to Tan) and n display periods (Td1 to Tdn) in one frame period. The horizontal axis indicates time and the vertical axis indicates the position of writing gate signal lines and display gate signal lines of pixels. Details about how pixels are driven are described in Embodiment Mode 1 and the explanation is therefore omitted here.

When the driving method uses 6 bit digital video signals, one frame period has at least six sub-frame periods SF1 to SF6.

The sub-frame period SF1 is for a 1 bit digital video signal, SF2 is for a 2 bit digital video signal, and the same applies to the rest of the sub-frame periods. The sub-frame periods SF1 to SF6 have six writing periods (Ta1 to Ta6) and six display periods (Td1 to Td6).

A writing period Tam (m is an arbitrary number ranging from 1 to 6) and a display period Tdm that are for a m bit digital video signal make a sub-frame period SFm. The writing period Tam is followed by a display period that is for the digital video signal of the same bit, in this case, the display period Tdm.

The writing period Ta and the display period Td are repeatedly alternated in one frame period to display one image.

The length of the display periods Td1 to Td6 is set so as to satisfy Td1:Td2: . . . :Td6$=2^0:2^1:\ldots:2^5$.

According to the driving method of this embodiment, gray scale display is obtained by controlling the total light emission time of a pixel in one frame period, namely, for how many display periods in one frame period the pixel is lit.

The structure of this embodiment can be combined freely with Embodiment 1.

Embodiment 3

This embodiment gives a description on an example of a driving method which is different from the one described in Embodiment Mode 1 and uses n bit digital video signals.

Figure 12:
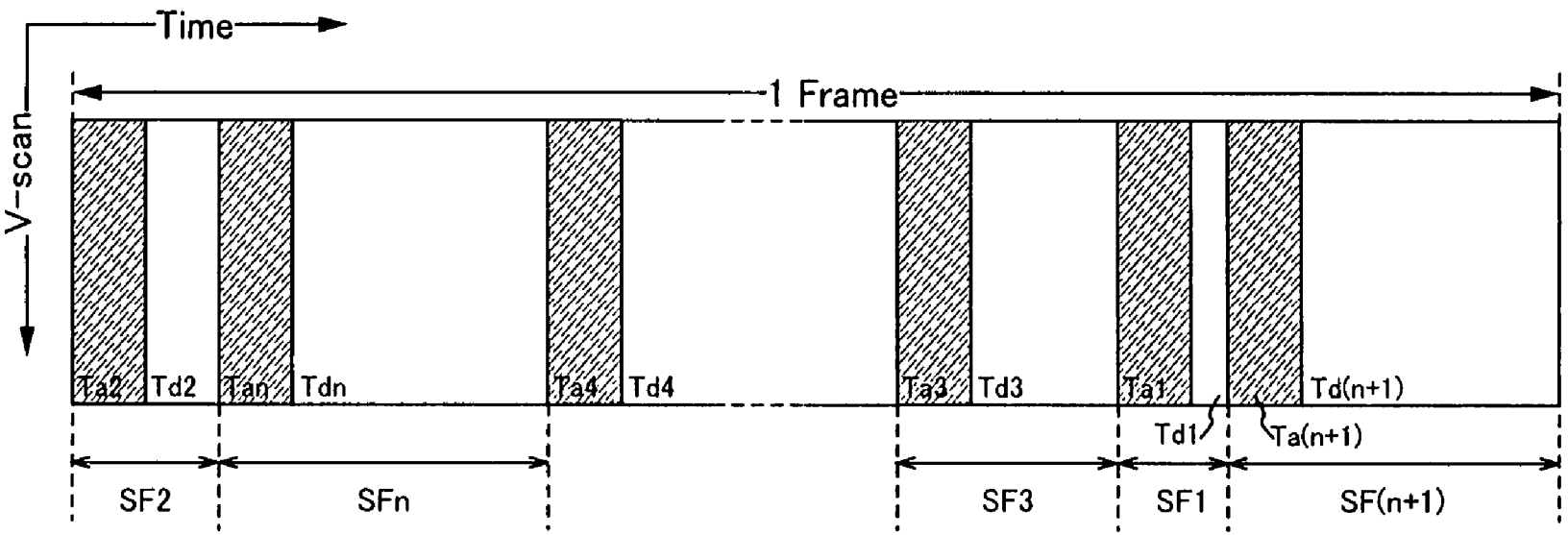
FIG. 12 is a timing chart of signals inputted to writing gate signal lines and display gate signal lines.

FIG. 12 is a timing diagram of (n+1) writing periods (Ta1 to Ta(n+1)) and n display periods (Td1 to Td(n+1)) in one frame period. The horizontal axis indicates time and the vertical axis indicates the position of writing gate signal lines and display gate signal lines of pixels. Details about how pixels are driven are described in Embodiment Mode 1 and the explanation is therefore omitted here.

In this embodiment, one frame period has (n+1) sub-frame periods SF1 to SF(n+1) in accordance with n bit digital video signals. The sub-frame periods SF1 to SF(n+1) have (n+1) writing periods (Ta1 to Ta(n+1)) and n display periods (Td1 to Td(n+1)).

A writing period Tam (m is an arbitrary number ranging from 1 to n+1) and a display period Tdm make a sub-frame period SFm. The writing period Tam is followed by a display period that is for the digital video signal of the same bit, in this case, the display period Tdm.

The sub-frame periods SF1 to SF(n−1) are for 1 to (n−1) bit digital video signals, respectively. The sub-frame periods SFn and SF(n+1) are for a n bit digital video signal.

The sub-frame periods SFn and SF(n+1) that are for the digital video signal of the same bit do not immediately follow each other in this embodiment. In other words, the sub-frame periods SFn and SF(n+1) that are for the digital video signal of the same bit sandwich another sub-frame period.

The writing period Ta and the display period Td are repeatedly alternated in one frame period to display one image.

The length of the display periods Td1 to Td(n+1) is set so as to satisfy Td1: Td2: . . . :(Tdn+Td(n+1))$=2^0:2^1:\ldots:2^{n-1}$.

According to the driving method of the present invention, gray scale display is obtained by controlling the total light emission time of a pixel in one frame period, namely, for how many display periods in one frame period the pixel is lit.

The above structure makes the uneven display in middle gray scale display less recognizable to the human eye than in Embodiments 1 and 2. The uneven display is caused by adjoining display periods during which light is emitted from pixels in adjacent frame periods.

Described in this embodiment is the case in which two sub-frame periods are provided for the digital video signal of the same bit. However, the present invention is not limited thereto. Three or more sub-frame periods may be provided for the digital video signal of the same bit in one frame period.

Although a plurality of sub-frame periods are provided for the most significant bit digital video signal in this embodiment, the present invention is not limited thereto. A digital video signal of other bit than the most significant bit may have a plurality of sub-frame periods. There is no need to limit the number of digital video signal bits that can have a plurality of sub-frame periods to one. A digital video signal of certain bit and a digital video signal of another bit can respectively have plural sub-frame periods.

The structure of this embodiment is effective when $n \geqq 2$. This embodiment can be combined freely with Embodiments 1 and 2.

Embodiment 4

This embodiment describes a case of using 6 bit digital video signals in the driving method of Embodiment Mode 2 in order to display an image in $2^6$ gray scales. The case described in this embodiment is about when m=5. However, note that the description 20 given in this embodiment is merely an example of the driving method of the present invention, and that the present invention is not limited by this embodiment regarding the bit number of digital video signals and the numerical value of m.

Figure 13:
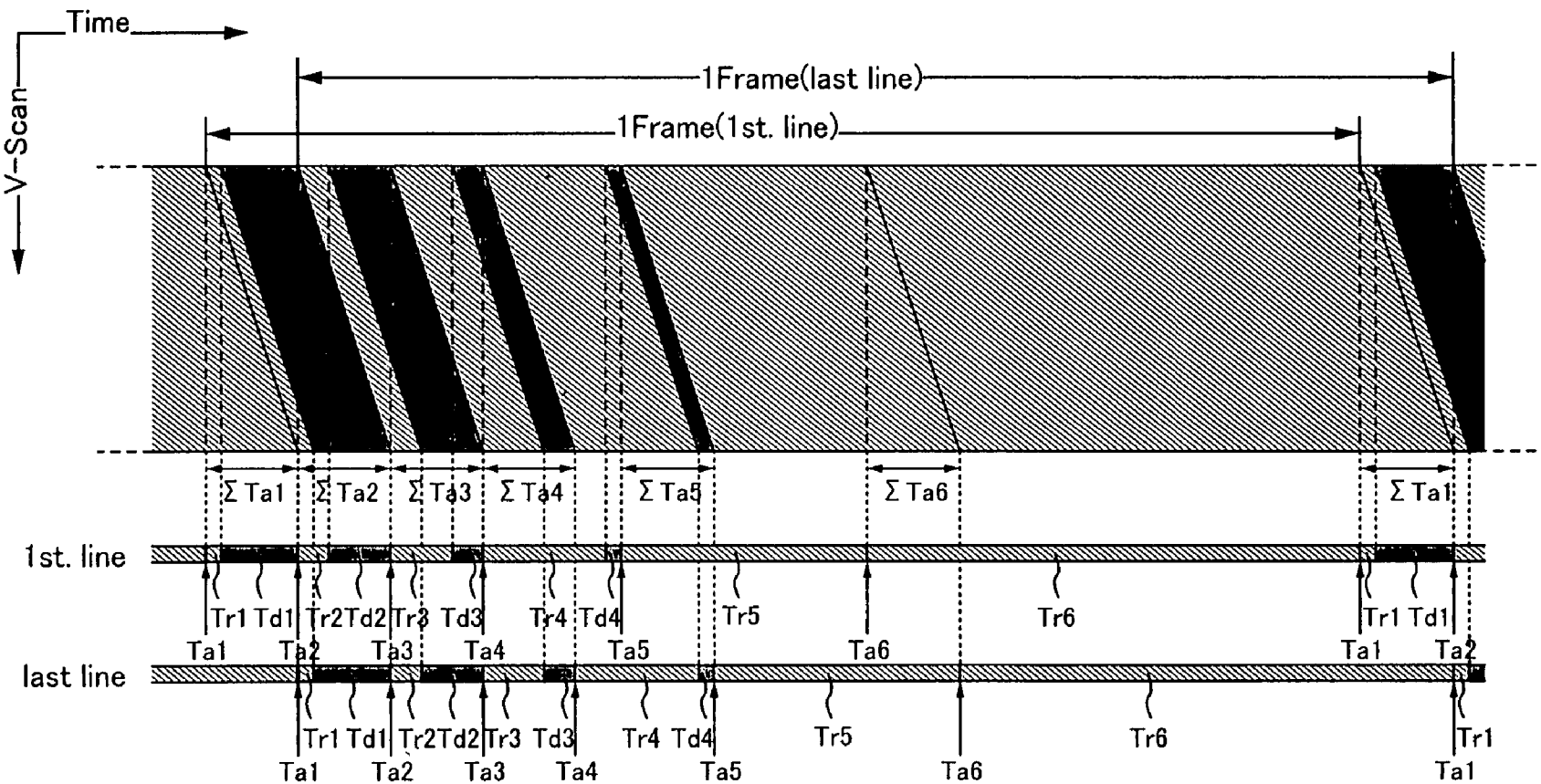
FIG. 13 is a timing diagram of writing periods, display periods, and non-display periods.

FIG. 13 is a timing diagram of writing periods, display periods, and non-display periods according to the driving method of this embodiment. The horizontal axis indicates time and the vertical axis indicates the position of writing gate signal lines and display gate signal lines of pixels. The writing periods are not shown as bands in FIG. 13 because they are short. Instead, for less crowded view, arrows indicate starting points of the writing periods Ta1 to Ta6 for 1 to 6 bit digital video signals. A period that begins with the start of a writing period in the pixels on Line One and ends with the end of a writing period in the pixels on Line Y for a 1 bit digital video signal is denoted by ΣTa1 and indicated by an arrow. 2 to 6 bit digital video signals have similar periods, ΣTa2 to ΣTa6, indicated by arrows.

Details about how pixels operate are described in Embodiment Mode 1 and the explanation is therefore omitted here.

First, the writing period Ta1 is started in pixels on Line One. When the writing period Ta1 is started, a 1 bit digital video signal is written in the pixels on Line One as described in Embodiment Mode 1.

After the writing period Ta1 is ended in the pixels on Line One, the writing period Ta1 is started in the pixels on Line Two and in pixels on the subsequent lines in order. Similarly to the pixels on Line One, a 1 bit digital video signal is inputted to the pixels on the rest of the lines.

While the writing period Ta1 is started in the pixels on Line Two and in pixels on the subsequent lines, the display period Tr1 is started in the pixels on Line One. As the display period Tr1 is started, pixels on Line One are lit up for display in accordance with a 1 bit digital video signal.

After the display period Tr1 is started in the pixels on Line One, the writing period Ta1 is ended and the display period Tr1 is started in the pixels on Line Two and in pixels on the subsequent lines in order. Thus the pixels on the respective lines are lit up for display in accordance with a 1 bit digital video signal.

While the display period Tr1 is started in the pixels on Line Two and in pixels on the subsequent lines, the display period Tr1 is ended and the non-display period Td1 is started in the pixels on Line One.

The pixels on Line One are no longer lit up for display when the non-display period Td1 is started.

After the non-display period Td1 is started in the pixels on Line One, the display period Tr1 is ended and the non-display period Td1 is started in the pixels on Line Two and in pixels on the subsequent lines. Then the pixels on every line stop being lit up for display.

While the non-display period Td1 is started in the pixels on Line Two and in pixels on the subsequent lines, or after the non-display period Td1 is started in all pixels, the writing period Ta2 is started in the pixels on Line One.

In the pixels on Line One, a 2 bit digital video signal is inputted as the writing period Ta2 is started.

The operation described above is repeated until it is time to input a 5 bit digital video signal to pixels. During the operation, the writing period Ta, the display period Tr, and the non-display period Td repeatedly take turns in pixels on each line.

Described next is the operation of the pixels after the writing period Ta5 in which a 5 bit digital video signal is inputted to pixels is started.

As the writing period Ta5 is started in the pixels on Line One, a 5 bit digital video signal is inputted to the pixels on Line One. When the writing period Ta5 is ended in the pixels on Line One, the writing period Ta5 is started in the pixels on Line Two and in pixels on the subsequent lines in order.

While the writing period Ta5 is started in the pixels on Line Two and in pixels on the subsequent lines after the writing period Ta5 is ended in the pixels on Line One, the display period Tr5 is started in the pixels on Line One. The pixels are lit up for display in accordance with a 5 bit digital video signal in the display period Tr5.

After the display period Tr5 is started in the pixels on Line One, the writing period Ta5 is ended and the display period Tr5 is started in the pixels on Line Two and in pixels on the subsequent lines in order.

The display period Tr5 is ended and the writing period Ta6 is started in the pixels on Line One after the display period Tr5 is started in the pixels on every line.

As the writing period Ta6 is started in the pixels on Line One, a 6 bit digital video signal is inputted to the pixels on Line One.

Then the writing period Ta6 is ended in the pixels on Line One. After the writing period Ta6 is ended in the pixels on Line One, the display period Tr5 is ended and the writing period Ta6 is started in the pixels on Line Two and in pixels on the subsequent lines in order.

While the writing period Ta5 is started in the pixels on Line Two and in pixels on the subsequent lines, the display period Tr5 is started in the pixels on Line One. As the display period Tr5 is started, pixels on Line One are lit up for display in accordance with a 6 bit digital video signal.

After the display period Tr5 is started in the pixels on Line One, the writing period Ta5 is ended and the display period Tr5 is started in the pixels on Line Two and in pixels on the subsequent lines in order. Thus the pixels on the respective lines are lit up for display in accordance with a 6 bit digital video signal.

Upon completion of Tr6 in the pixels on Line One, one frame period is ended. Then the writing period Ta1 is again started in the pixels on Line One for the next frame period. After Tr6 is ended in the pixels on Line One, the pixels on Line Two and pixels on the subsequent lines finish Tr6 to complete one frame period. Then the Ta1 is started in the pixels on Line Two and pixels on the subsequent lines for the next frame period.

The operation described above is repeated again. The starting point and the ending point of one frame period for pixels on a line is different from the starting point and the ending point of one frame period for pixels on another line.

When one frame period is completed for the pixels on all the lines, one image is displayed.

In this embodiment, the length of the display periods is set so as to satisfy Tr1:Tr2: . . . :Tr5:Tr6=$2^0$:$2^1$: . . . :$2^4$:$2^5$. By changing the combination of the display periods during which light is emitted from a pixel, the pixel can obtain a desired gray scale within $2^6$ gray scales.

The total length of display periods during which an EL element emits light in one frame period determines the gray scale of the pixel having that EL element in that particular frame period. For example, the luminance of a pixel that is lit up for all display periods is 100% in this embodiment. Then if a pixel is lit up in Tr1 and Tr2, the luminance of the pixel is 5%. If a pixel is lit up in Tr3 and Tr5, the luminance of the pixel is 32%.

A writing period of pixels on a line does not overlap a writing period of pixels on another line in the present invention. Therefore, a writing period in the pixels on Line One is started after a writing period in the pixels on Line Y is ended.

The length of the display period Tr5 in the pixels on any line has to be longer than the period that begins with the start of the writing period Ta5 in the pixels on Line One and ends with the end of the writing period Ta5 in the pixels on Line Y (ΣTa5).

The display periods Tr1 to Tr6 may be run in random order. For example, Tr3, Tr5, Tr2, . . . may follow Tr1 in the order stated in one frame period. However, a writing period of pixels on a line should not overlap a writing period of pixels on another line.

In the driving method of the present invention, the length of the display period of pixels on any line can be shorter than the period that begins with the start of the writing period Ta of the pixels on Line One and ends with the end of the writing period Ta of the pixels on Line Y, namely, the period required for writing one bit digital video signal in all pixels. Accordingly, if the bit number of digital video signals is increased, the length of the display period for a digital video signal of less significant bit can be reduced, whereby a high definition image can be displayed without flicker on the screen.

The light emitting device of the present invention can obtain a constant level of luminance irrespective of temperature change. Furthermore, if different EL materials are used in EL elements of different colors in order to display in color, temperature change does not cause varying degrees of changes in luminance between the EL elements of different colors and a failure to obtain desired colors is thus avoided.

Embodiment 5

This embodiment describes in what order the display periods Tr1 to Tr6 are run when 6 bit digital video signals are used in the driving method of Embodiment Mode 2. The case described in this embodiment is about when m=5. However, note that the description given in this embodiment is merely an example of the driving method of Embodiment Mode 2, and that the present invention is not limited by this embodiment regarding the bit number of digital video signals and the numerical value of m. The structure of this embodiment is effective when 3 or greater bit digital video signals are used.

Figure 14:
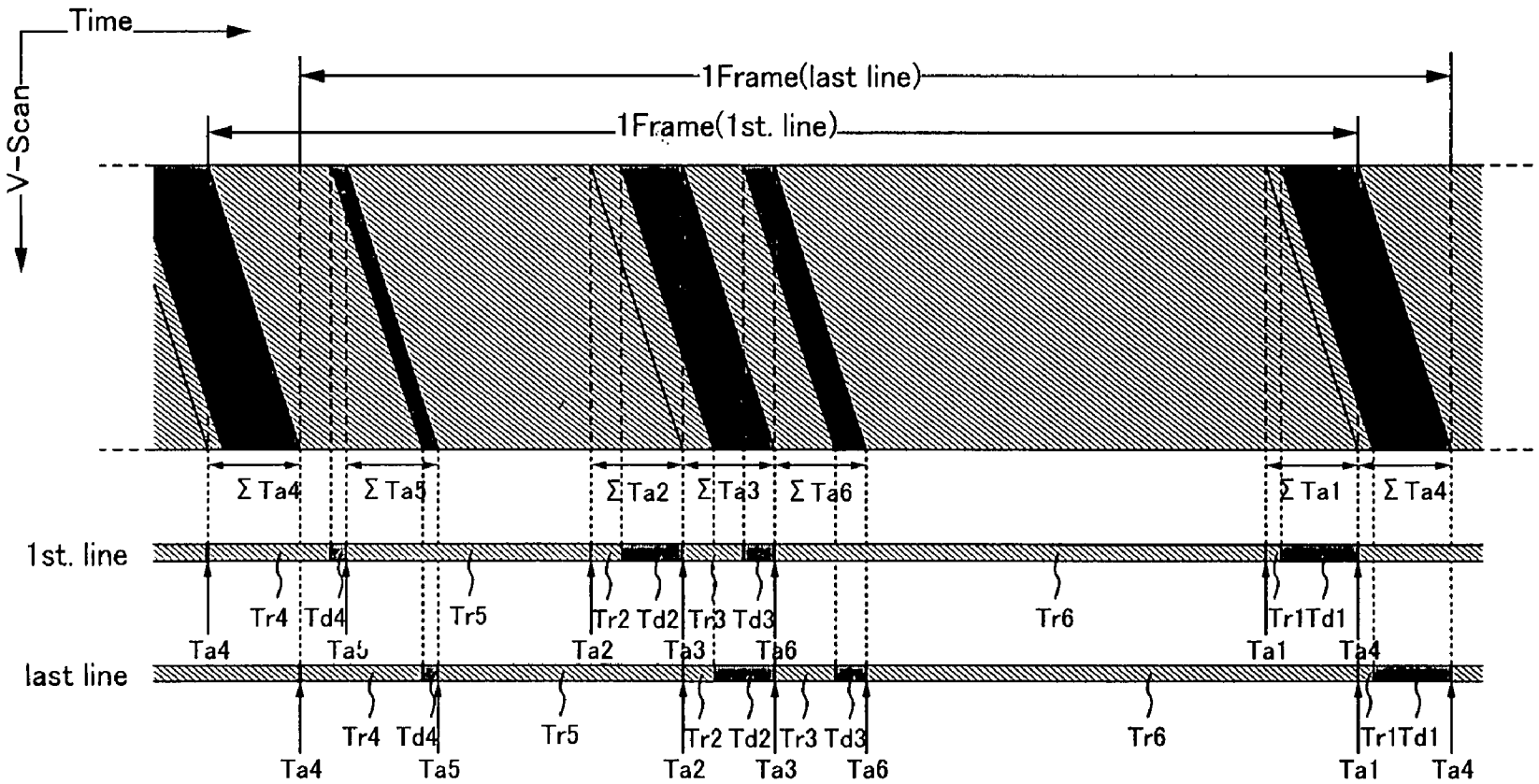
FIG. 14 is a timing diagram of writing periods, display periods, and non-display periods.

FIG. 14 is a timing diagram of writing periods, display periods, and non-display periods according to the driving method of this embodiment. The horizontal axis indicates time and the vertical axis indicates the position of writing gate signal lines and display gate signal lines of pixels. The writing periods are not shown as bands in FIG. 14 because they are short. Instead, for less crowded view, arrows indicate starting points of the writing periods Ta1 to Ta6 for 1 to 6 bit digital video signals. A period that begins with the start of a writing period in the pixels on Line One and ends with the end of a writing period in the pixels on Line Y for a 1 bit digital video signal is denoted by ΣTa1 and indicated by an arrow. 2 to 6 bit digital video signals have similar periods, ΣTa2 to ΣTa6, indicated by arrows.

Details about how pixels operate are described in Embodiment Mode 2 and the explanation is therefore omitted here.

First, the writing period Ta4 is started in pixels on Line One. When the writing period Ta4 is started, a 4 bit digital video signal is written in the pixels on Line One.

As the writing period Ta4 is ended in the pixels on Line One, the writing period Ta4 is started in the pixels on Line Two and in pixels on the subsequent lines in order. Similarly to the pixels on Line One, a 4 bit digital video signal is inputted to the pixels on the rest of the lines.

While the writing period Ta4 is started in the pixels on Line Two and in pixels on the subsequent lines, the display period Tr4 is started in the pixels on Line One. As the display period Tr4 is started, pixels on Line One are lit up for display in accordance with a 4 bit digital video signal.

After the display period Tr4 is started in the pixels on Line One, the writing period Ta4 is ended and the display period Tr4 is started in the pixels on Line Two and in pixels on the subsequent lines in order. Thus the pixels on the respective lines are lit up for display in accordance with a 4 bit digital video signal.

After the display period Tr4 is started in the pixels on Line Two and in pixels on the subsequent lines, the display period Tr4 is ended and the non-display period Td4 is started in the pixels on Line One. Alternatively, the pixels on Line One may end the display period Tr4 and start the non-display period Td4 while the display period Tr4 is started in the pixels on Line Two and in pixels on the subsequent lines.

The pixels on Line One are no longer lit up for display when the non-display period Td4 is started.

After the non-display period Td4 is started in the pixels on Line One, the display period Tr4 is ended and the non-display period Td4 is started in the pixels on Line Two and in pixels on the subsequent lines. Then the pixels on every line stops being lit up for display.

While the non-display period Td4 is started in the pixels on Line Two and in pixels on the subsequent lines, or after the non-display period Td4 is started in all pixels, the writing period Ta5 is started in the pixels on Line One.

In the pixels on Line One, a 5 bit digital video signal is inputted as the writing period Ta5 is started in the pixels on Line One. When the writing period Ta5 is ended in the pixels on Line One, the writing period Ta5 is started in the pixels on Line Two and in pixels on the subsequent lines in order.

While the writing period Ta5 is started in the pixels on Line Two and in pixels on the subsequent lines after the writing period Ta5 is ended in the pixels on Line One, the display period Tr5 is started in the pixels on Line One. The pixels are lit up for display in accordance with a 5 bit digital video signal in the display period Tr5.

After the display period Tr5 is started in the pixels on Line One, the writing period Ta5 is ended and the display period Tr5 is started in the pixels on Line Two and in pixels on the subsequent lines in order.

The display period Tr5 is ended and the writing period Ta2 is started in the pixels on Line One after the display period Tr5 is started in the pixels on all the lines.

As the writing period Ta2 is started in the pixels on Line One, a 2 bit digital video signal is inputted to the pixels on Line One.

Then the writing period Ta2 is ended in the pixels on Line One. After that, the writing period Ta2 is started in the pixels on Line Two and in pixels on the subsequent lines in order. Similarly to the pixels on Line One, a 2 bit digital video signal is inputted to the pixels on the rest of the lines.

While the writing period Ta2 is started in the pixels on Line Two and in pixels on the subsequent lines, the display period Tr2 is started in the pixels on Line One. As the display period Tr2 is started, the pixels on Line One are lit up for display in accordance with a 2 bit digital video signal.

After the display period Tr2 is started in the pixels on Line One, the writing period Ta2 is ended and the display period Tr2 is started in the pixels on Line Two and in pixels on the subsequent lines in order. Thus the pixels on the respective lines are lit up for display in accordance with a 2 bit digital video signal.

While the display period Tr2 is started in the pixels on Line Two and in pixels on the subsequent lines, the display period Tr2 is ended and the non-display period Td2 is started in the pixels on Line One.

When the non-display period Td2 is started, the pixels on Line One are no longer lit up for display.

After the non-display period Td2 is started in the pixels on Line One, the display period Tr2 is ended and the non-display period Td2 is started in the pixels on Line Two and in pixels on the subsequent lines. Thus the pixels on the respective lines are no longer lit up for display.

While the non-display period Td2 is started in the pixels on Line Two and in pixels on the subsequent lines, or after the non-display period Td2 is started in all pixels, the writing period Ta3 is started in the pixels on Line One.

The operation described above is repeated until all of 1 through 6 bit digital video signals are inputted to the pixels. During the operation, the writing period Ta, the display period Tr, and the non-display period Td repeatedly take turns in pixels on each line.

Upon completion of all of the display periods Tr1 to Tr6 in the pixels on Line One, one frame period is ended for the pixels on Line One. Then the writing period that comes first (Ta4, in this embodiment) is again started in the pixels on Line One for the next frame period. After one frame period is ended in the pixels on Line One, the pixels on Line Two and pixels on the subsequent lines finish one frame period as well Then the writing period Ta4 is started in the pixels on Line Two and pixels on the subsequent lines for the next frame period.

The operation described above is repeated again. The starting point and the ending point of one frame period for pixels on a line is different from the starting point and the ending point of one frame period for pixels on another line.

When one frame period is completed for the pixels on all the lines, one image is displayed.

In this embodiment, the length of the display periods is set so as to satisfy Tr1:Tr2: . . . :Tr5:Tr6=$2^0$:$2^1$: . . . :$2^4$:$2^5$. By changing the combination of the display periods during which light is emitted from a pixel, the pixel can obtain a desired gray scale within $2^6$ gray scales.

The total length of display periods during which an EL element emits light in one frame period determines the gray scale of the pixel having that EL element in that particular frame period. For example, the luminance of a pixel that is lit up for all display periods is 100% in this embodiment. Then if a pixel is lit up in Tr1 and Tr2, the luminance of the pixel is 5%. If a pixel is lit up in Tr3 and Tr5, the luminance of the pixel is 32%.

A writing period of pixels on a line does not overlap a writing period of pixels on another line in the present invention. Therefore, a writing period in the pixels on Line One is started after a writing period in the pixels on Line Y is ended.

In this embodiment, the length of the display period Tr5 in the pixels on any line has to be longer than the period that begins with the start of the writing period Ta5 in the pixels on Line One and ends with the end of the writing period Ta5 in the pixels on Line Y (ΣTa5).

The display periods Tr1 to Tr6 may be run in random order. For example, Tr3, Tr5, Tr2, . . . may follow Tr1 in the order stated in one frame period. However, a writing period of pixels on a line should not overlap a writing period of pixels on another line.

In the driving method of this embodiment, the length of the display period of pixels on any line can be shorter than the period that begins with the start of the writing period Ta of the pixels on Line One and ends with the end of the writing period Ta of the pixels on Line Y, namely, the period required for writing one bit digital video signal in all pixels. Accordingly, if the bit number of digital video signals is increased; the length of the display period for a digital video signal of less significant bit can be reduced, whereby a high definition image can be displayed without flicker on the screen.

The light emitting device of the present invention can obtain a constant level of luminance irrespective of temperature change. Furthermore, if different EL materials are used in EL elements of different colors in order to display in color, temperature change does not cause varying degrees of changes in luminance between the EL elements of different colors and a failure to obtain desired colors is thus avoided.

According to the driving method of this embodiment, the longest display period in one frame period (Tr6, in this embodiment) does not come first or last in the one frame period. In other words, the longest display period in one frame period is sandwiched between other display periods of the same frame period.

The above structure makes the uneven display in middle gray scale display less recognizable to the human eye. The uneven display is caused by adjoining display periods during which light is emitted from pixels in adjacent frame periods.

The structure of this embodiment can be combined freely with Embodiment 4.

Embodiment 6

This embodiment gives a description on an example of a driving method which is different from the one described in Embodiment Mode 2 and uses n bit digital video signals. The case described in this embodiment is about when m=n−2.

In the driving method of this embodiment, the display period Tm that is for the most significant bit digital video signal is divided into a first display period Trn_1 and a second display period Trn_2. The first display period Trn_1 and the second display period Trn_2 are accompanied with a first writing period Tan_1 and a second writing period Tan_2, respectively.

Figure 15:
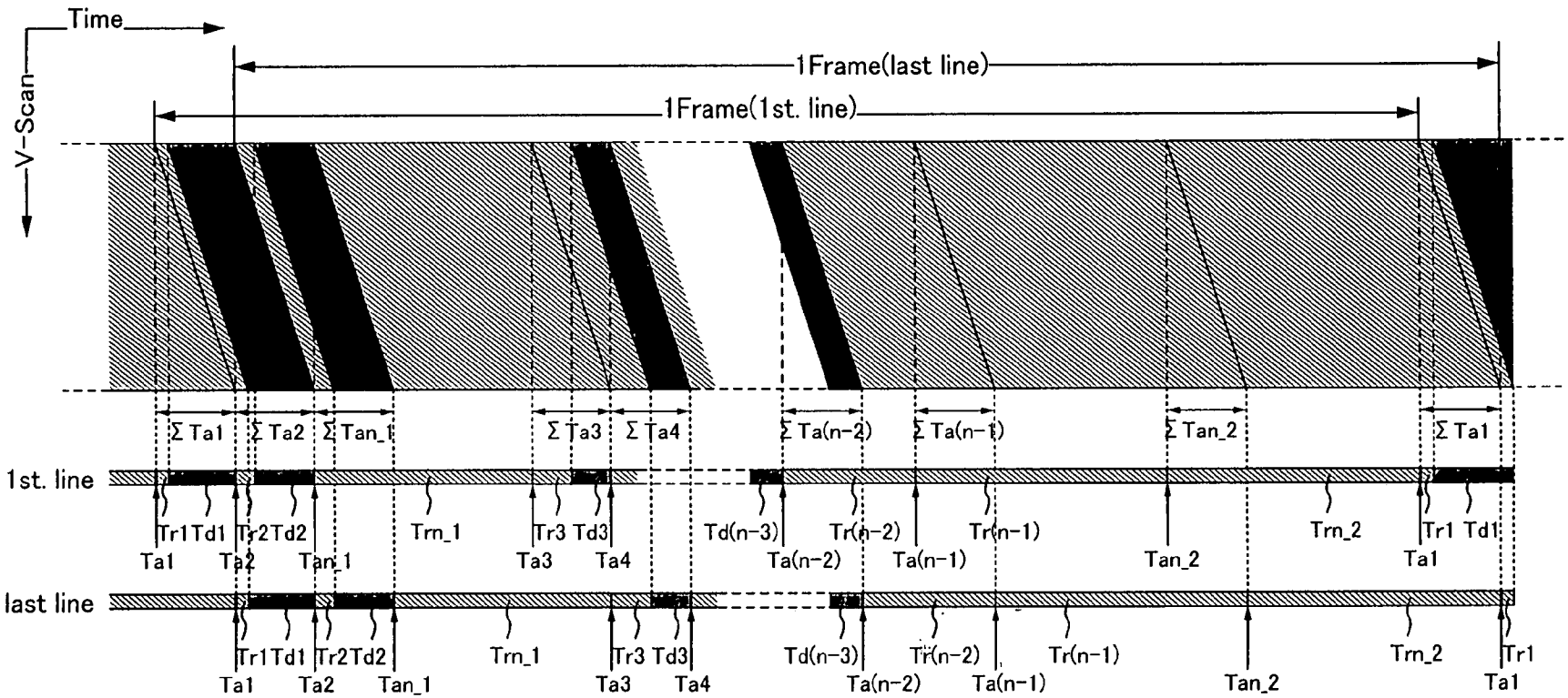
FIG. 15 is a timing diagram of writing periods, display periods, and non-display periods.

FIG. 15 is a timing diagram of writing periods, display periods, and non-display periods according to the driving method of this embodiment. The horizontal axis indicates time and the vertical axis indicates the position of writing gate signal lines and display gate signal lines of pixels. The writing periods are not shown as bands in FIG. 15 because they are short. Instead, for less crowded view, arrows indicate starting points of the writing periods Ta1 to Ta(n−1), and Tan_1 and Tan_2 for 1 to n bit digital video signals. A period that begins with the start of a writing period in the pixels on Line One and ends with the end of a writing period in the pixels on Line Y for a 1 bit digital video signal is denoted by ΣTa1 and indicated by an arrow. 2 to n bit digital video signals have similar periods, ΣTa2 to ΣTa(n−1), and ΣTan_1 and ΣTan_2, indicated by arrows.

Details about how pixels operate are described in Embodiment Mode 2 and the explanation is therefore omitted here.

In this embodiment, the first display period Trn_1 and the second display period Trn_2 that are for the digital video signal of the same most significant bit sandwich a display period for a digital video signal of other bit than the most significant bit.

The length of the display periods Tr1 to Tr(n−1), and Trn_1 and Trn_2 is set so as to satisfy Tr1:Tr2: . . . :Tr(n−1):(Trn_1+Trn_2)=$2^0$:$2^1$: . . . :$2^{n-2}$:$2^{n-1}$.

According to the driving method of the present invention, gray scale display is obtained by controlling the total light emission time of a pixel in one frame period, namely, for how many display periods in one frame period the pixel is lit.

The above structure makes the uneven display in middle gray scale display less recognizable to the human eye than in Embodiments 4 and 5. The uneven display is caused by adjoining display periods during which light is emitted from pixels in adjacent frame periods.

Described in this embodiment is the case in which two display periods are provided for the digital video signal of the same bit. However, the present invention is not limited thereto. Three or more display periods may be provided for the digital video signal of the same bit in one frame period.

Although a plurality of display periods are provided for the most significant bit digital video signal, the present invention is not limited thereto. A digital video signal of other bit than the most significant bit may have a plurality of display periods. There is no need to limit the number of digital video signal bits that can have a plurality of display periods to one. A digital video signal of certain bit and a digital video signal of another bit can respectively have plural display periods.

The structure of this embodiment is effective when n≧2. This embodiment can be combined freely with Embodiment 4 or 5.

Embodiment 7

This embodiment describes structures of driving circuits (a source signal line driving circuit and gate signal line driving circuits) of a light emitting device according to the present invention.

Figure 16:
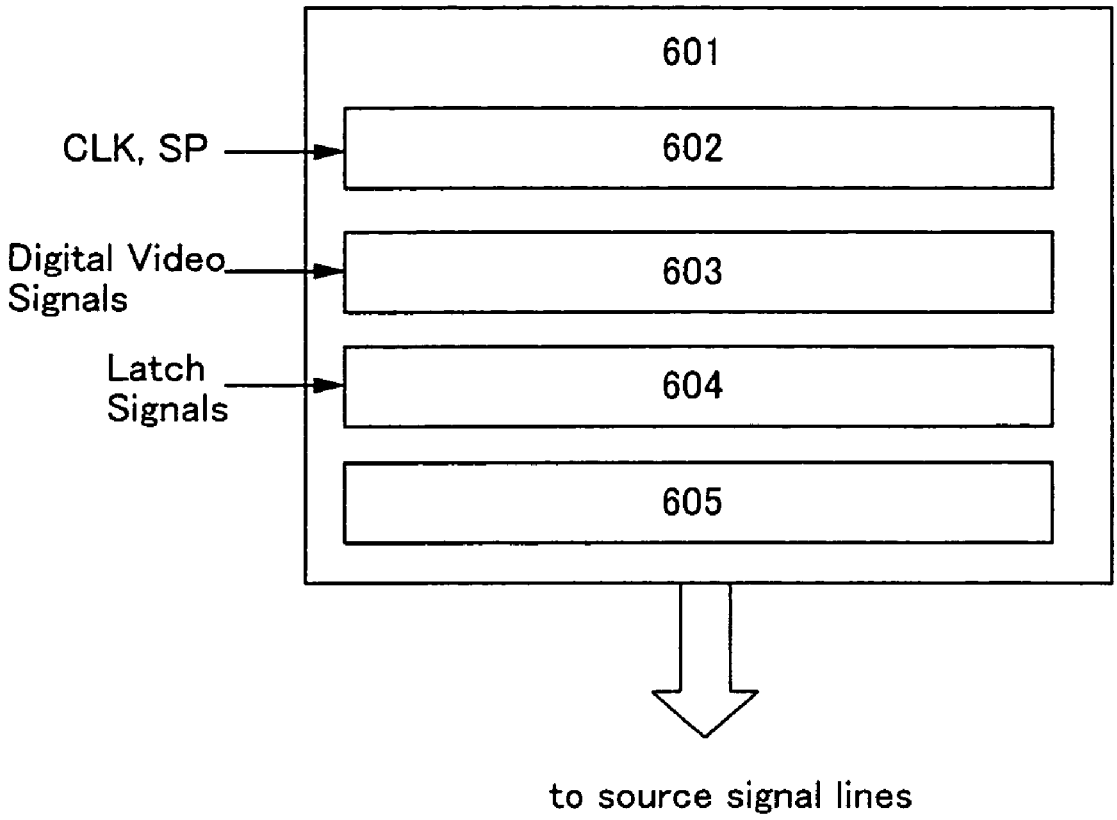
FIG. 16 is a block diagram showing a source signal line driving circuit.

FIG. 16 is a block diagram showing the structure of a source signal line driving circuit 601. Denoted by 602 is a shift register, 603, a memory circuit A, 604, a memory circuit B, and 605, a constant current circuit.

Clock signals CLK and start pulse signals SP are inputted to the shift register 602. Digital video signals are inputted to the memory circuit A 603 whereas latch signals are inputted to the memory circuit B 604. A constant current Ic is outputted from the constant current circuit 605 and is inputted to source signal lines.

Figure 17:
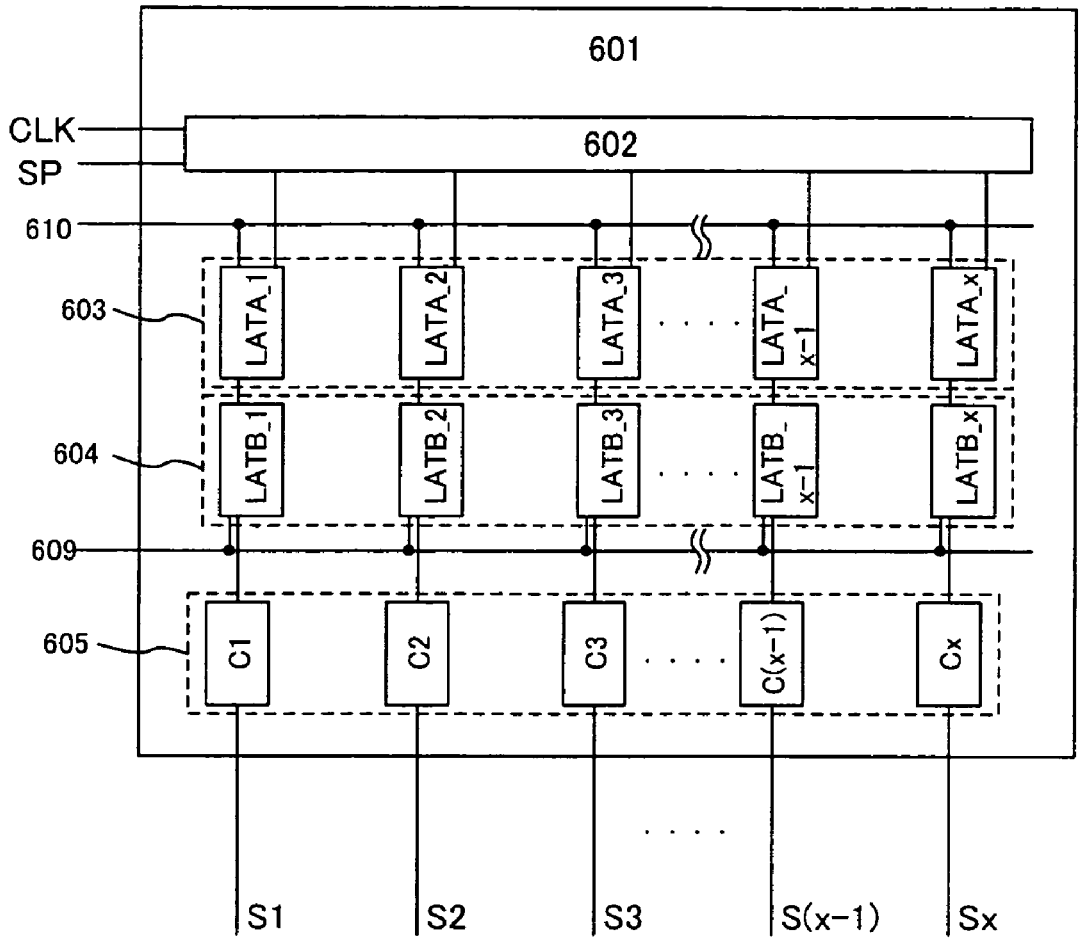
FIG. 17 is a detailed diagram of the source signal line driving circuit.

FIG. 17 shows a more detailed structure of the source signal line driving circuit 601.

Input of clock signals CLK and start pulse signals SP from given wiring lines to the shift register 602 generates timing signals. The timing signals are inputted to a plurality of latches A (LATA_1 to LATA_x) of the memory circuit A 603. The timing signals generated in the shift register 602 may be buffered and amplified by a buffer or the like before inputted to the plural latches A (LATA_1 to LATA_x) of the memory circuit A 603.

When the timing signals are inputted to the memory circuit A 603, one bit digital video signals to be inputted to a video signal line 610 are written in the plural latches A (LATA_1 to LATA_x) in order in sync with the timing signals and held therein.

In this embodiment, the digital video signals are inputted to the memory circuit A 603 by inputting the digital video signals in the plural latches A (LATA_1 to LATA_x) of the memory circuit A 603 in order. However, the present invention is not limited thereto. The invention may employ a so-called division driving in which plural stages of lathes in the memory circuit A 603 are divided into a few groups and the digital video signals are inputted to the respective groups simultaneously. The number of groups in division driving is referred to as number of division. For example, if four stages of latches make one group, then it is four division driving.

The time required for completing writing digital video signals once into all stages of latches in the memory circuit A 603 is called a line period. However, sometimes the line period defined as above plus a horizontal retrace period are regarded as a line period.

Upon completion of one line period, latch signals are supplied to a plurality of latches B (LATB_1 to LATB_x) of the memory circuit B 604 through a latch signal line 609. At this instant, the digital video signals held in the plural latches A (LATA_1 to LATA_x) of the memory circuit A 603 are written in the plural latches B (LATB_1 to LATB_x) of the memory circuit B 604 at once to be held therein.

Having sent the digital video signals to the memory circuit B 604, the memory circuit A 603 now receives the next supply of one bit digital signals so that the digital video signals are written in order in response to timing signals from the shift register 602.

After one line period is thus started for the second time, the digital video signals written and held in the memory circuit B 604 are inputted to the constant current circuit 605.

The constant current circuit 605 has a plurality of current setting circuits (C1 to Cx). When the digital video signals are inputted to the respective current setting circuits (C1 to Cx), the source signal lines receive the constant current Ic or the electric potential of power supply lines V1 to Vx, depending on which information of '1' and '0' the digital video signals carry.

Figure 18:
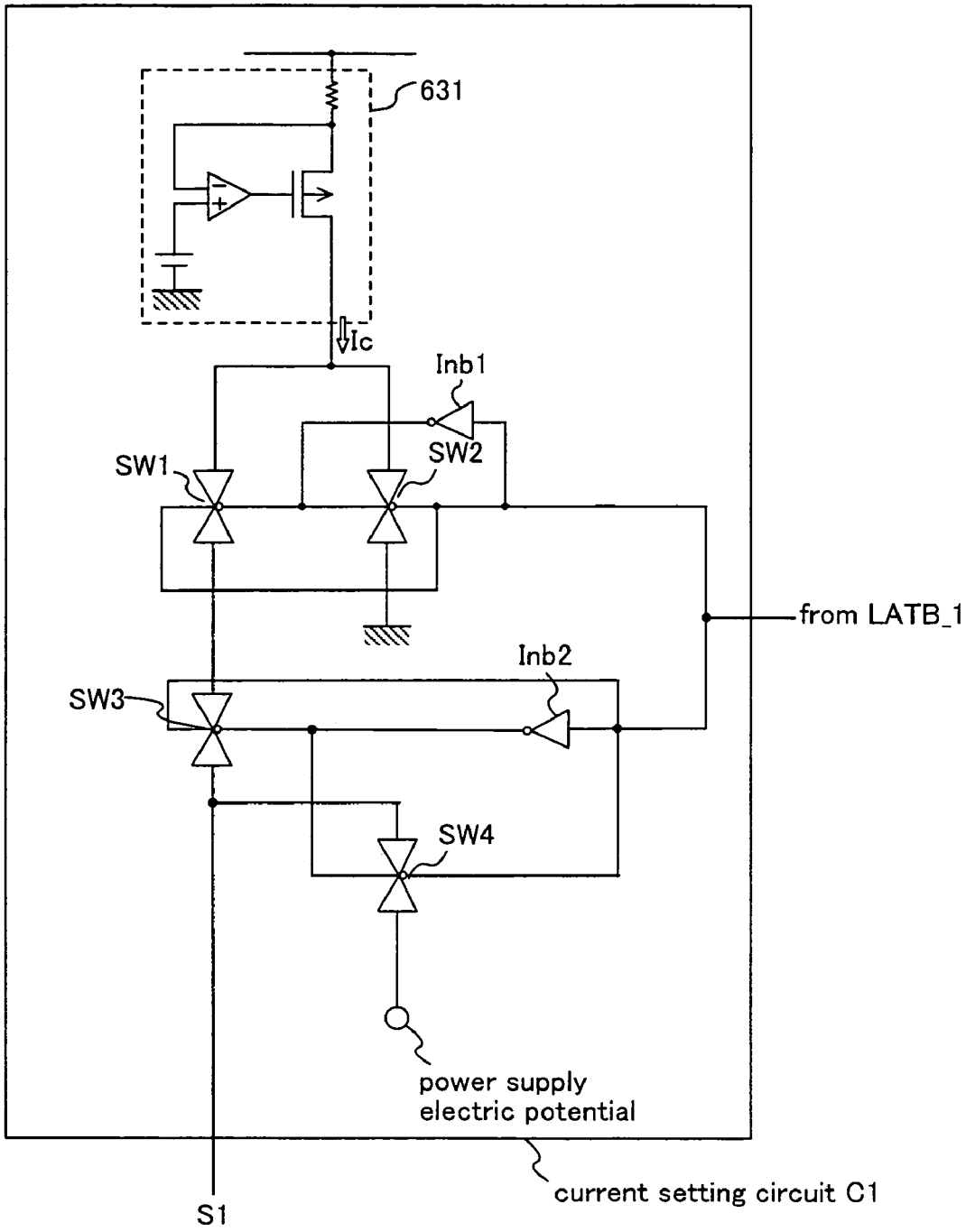
FIG. 18 is a circuit diagram of a current setting circuit C1.

FIG. 18 shows an example of the specific structure of the current setting circuit C1. This structure is also employed by the current setting circuits C2 to Cx.

The current setting circuit C1 has a constant current supply 631, four transmission gates SW1 to SW4, and two inverters Inb1 and Inb2.

Digital video signals outputted from LATB_1 of the memory circuit B 604 are used to control switching of SW1 to SW4. Digital video signals inputted to SW1 and SW3 and digital video signals inputted to SW2 and SW4 are inverted to each other by Inb1 and Inb2. Therefore, SW2 and SW4 are OFF when SW1 and SW3 are ON and when SW1 and SW3 are OFF, SW2 and SW4 are ON.

When SW1 and SW3 are ON, the current Ic is inputted from the constant current supply 631 through SW1 and SW3 to a source signal line S1.

On the other hand, when SW2 and SW4 are ON, the current Ic from the constant current supply 631 is dropped to the ground through SW2 while the electric potential of the power supply lines V1 to Vx is given to the source signal line S1 through SW4.

Again referring to FIG. 17, the above operation is carried out in all of the current setting circuits (C1 to Cx) of the constant current circuit 605 in one line period. Accordingly, the digital video signals determine whether the constant current Ic or the power supply electric potential is given to all the source signal lines.

The shift register may be replaced by another circuit such as a decoder in order to write digital video signals in the latch circuits sequentially.

Next, structures of a writing gate signal line driving circuit and a display gate signal line driving circuit will be described. However, since the writing gate signal line driving circuit and the display gate signal line driving circuit have almost the same structure, only the description of the writing gate signal line driving circuit is given here as a representative.

Figure 19:
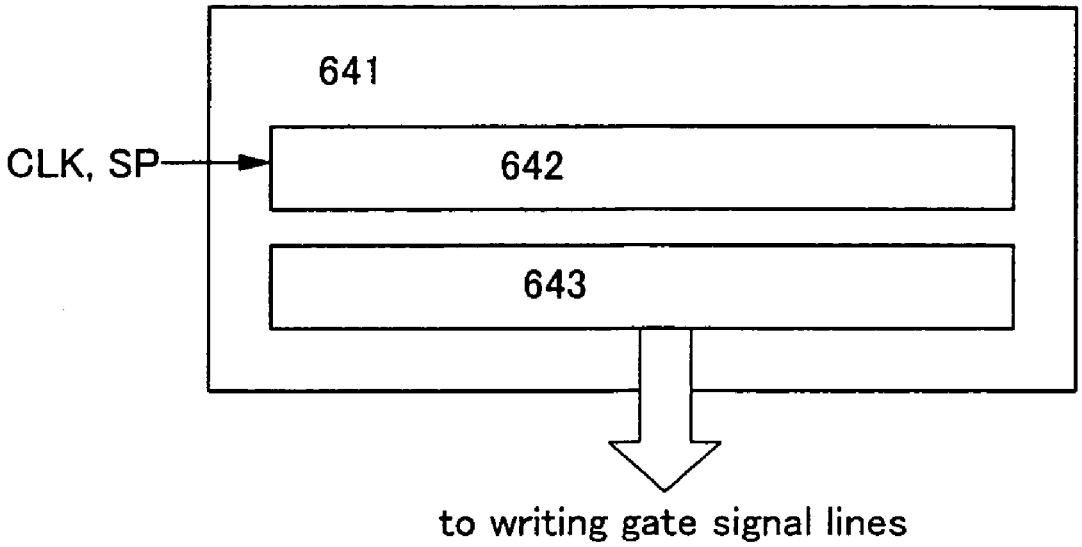
FIG. 19 is a block diagram showing a gate signal line driving circuit.

FIG. 19 is a block diagram showing the structure of a writing gate signal line driving circuit 641.

The writing gate signal line driving circuit 641 has a shift register 642 and a buffer 643. It may also have a level shifter if necessary.

In the writing gate signal line driving circuit 641, clock signals CLK and start pulse signals SP are inputted to the shift register 642 to generate timing signals. The timing signals generated are buffered and amplified by the buffer 643 to be supplied to a selected writing gate signal line.

Each writing gate signal line is connected to gate electrodes of a first switching TFT and a second switching TFT in each of pixels on one line. Since the first switching TFT and the second switching TFT in each of pixels on one line must be turned ON at once, the buffer 643 has to be capable of allowing a large amount of current to flow.

In the display gate signal line driving circuit, EL driving TFTs connected to all display gate signal lines are simultaneously turned ON in each display period. Therefore the clock signals CLK and the start pulse signals SP that are inputted to the shift register of the writing gate signal line driving circuit have different waveforms than CLK and SP that are inputted to the shift register of the display gate signal line driving circuit have.

The shift register may be replaced by another circuit such as a decoder in order to select a gate signal line and supply timing signals to the selected gate signal line.

The structure of the driving circuits used in the present invention is not limited to the one shown in this embodiment.

The structure of this embodiment can be combined freely with Embodiments 1 through 6.

Embodiment 8

This embodiment describes an example of a top view of a pixel structured as shown in FIG. 1.

Figure 20:
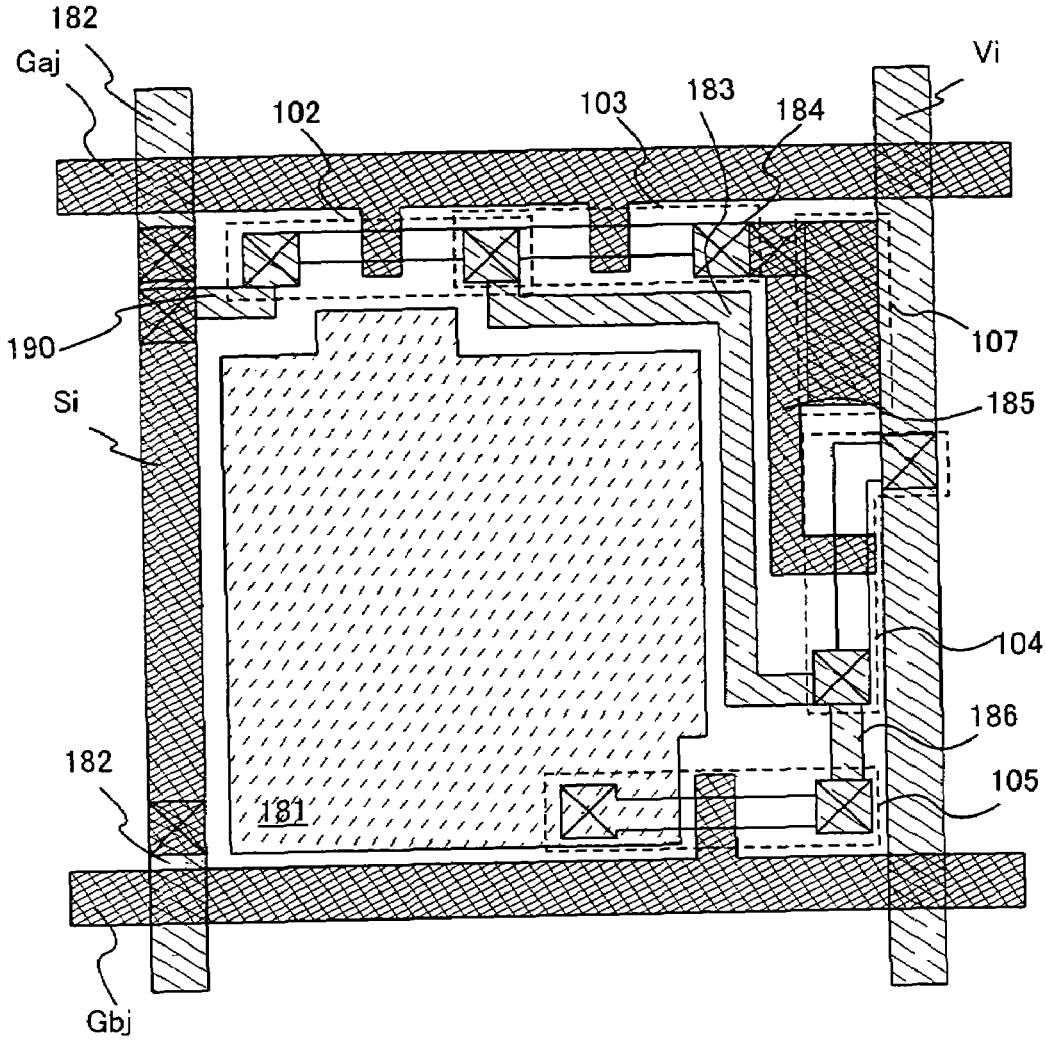
FIG. 20 is a top view of a pixel of a light emitting device according to the present invention.

FIG. 20 is a top view of the pixel of this embodiment. The pixel has a source signal line Si, a power supply line Vi, a writing gate signal line Gaj, and a display gate signal line Gbj. The source signal line Si crosses the writing gate signal line Gaj and the display gate signal line Gbj but is lead out by a connection wiring line 182 to avoid contact between the source signal line Si and the gate signal lines Gj.

Denoted by 102 and 103 are a first switching TFT and a second switching TFT, respectively. 104 and 105 denote a current controlling TFT and an EL driving TFT, respectively.

The first switching TFT 102 has a source region and a drain region one of which is connected to the source signal line Si through a connection wiring line 190 and the other of which is connected to a drain region of the current controlling TFT 104 through a connection wiring line 183. The second switching TFT 103 has a source region and a drain region one of which is connected to the drain region of the current controlling TFT 104 through the connection wiring line 183 and the other of which is connected to a connection wiring line 184 and to a gate wiring line 185. A part of the gate wiring line 185 function as a gate electrode of the current controlling TFT.

The writing gate signal line Gaj partially functions as gate electrodes of the first switching TFT 102 and the second switching TFT 103.

A part of the power supply line Vi overlaps a part of the gate wiring line 185 with an interlayer insulating film sandwiched therebetween. The overlap portion serves as a capacitor 107.

A source region of the current controlling TFT 104 is connected to the power supply line Vi and the drain region thereof is connected to a source region of the EL driving TFT 105 through a connection wiring line 186. A drain region of the EL driving TFT 105 is connected to a pixel electrode 181. A part of the display gate signal line Gbj functions as a gate electrode of the EL driving TFT 105.

The structure of the pixel of the light emitting device according to the present invention is not limited to the one shown in FIG. 20. The structure of this embodiment can be combined freely with Embodiments 1 through 7.

Embodiment 9

This embodiment gives a description on a method of manufacturing TFTs for a pixel portion of a light emitting device according to the present invention. TFTs for driving circuits (a source signal line driving circuit, a writing gate signal line driving circuit, and a display gate signal line driving circuit) provided in the periphery of the pixel portion may be formed on the same substrate on which the TFTs for the pixel portion are placed at the same time the pixel portion TFTs are formed.

Figure 21A:
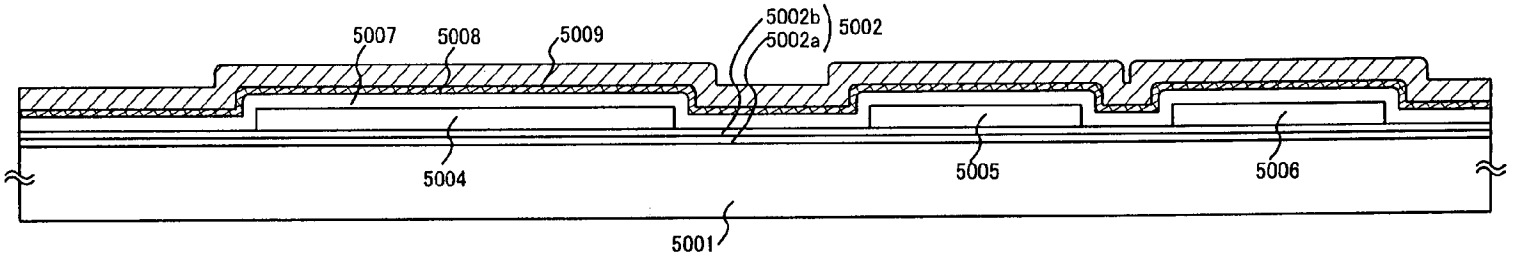
FIGS. 21A to 21C are diagrams showing a method of manufacturing a light emitting device according to the present invention.

First, as shown in FIG. 21A, a base film 5002 is formed from an insulating film such as a silicon oxide film, a silicon nitride film, and a silicon oxynitride film on a glass substrate 5001. The substrate 5001 is formed of barium borosilicate glass typical example of which is Corning #7059 glass or Corning #1737 glass (product of Coming Incorporated), or of aluminoborosilicate glass. The base film 5002 is, for example, a laminate of a silicon oxynitride film 5002*a* that is formed from $SiH_4$, $NH_3$, and $N_2O$ by plasma CVD to a thickness of 10 to 200 nm (preferably 50 to 100 nm) and a silicon oxynitride hydride film 5002*b* formed from $SiH_4$ and $N_2O$ by plasma CVD to a thickness of 50 to 200 nm (preferably 100 to 150 nm). Although the base film 5002 in this embodiment has a two-layer structure, it may be a single layer of one of the insulating films given in the above, or a laminate of two or more layers of those insulating films.

A semiconductor film having an amorphous structure is crystallized by laser crystallization or a known thermal crystallization method to form a crystalline semiconductor film. The crystalline semiconductor film makes island-like semiconductor layers 5004 to 5006. The island-like semiconductor layers 5004 to 5006 each have a thickness of 25 to 80 nm (preferably 30 to 60 nm). No limitation is put on the choice of material of the crystalline semiconductor film but it is preferable to use silicon or a silicon germanium (SiGe) alloy.

When the crystalline semiconductor film is formed by laser crystallization, a pulse oscillation type or continuous wave excimer laser, YAG laser, or $YVO_4$ laser is used. Laser light emitted from a laser as those given in the above is desirably collected into a linear beam by an optical system before irradiating the semiconductor film. Conditions of crystallization are set suitably by an operator. However, if an excimer laser is used, the pulse oscillation frequency is set to 300 Hz and the laser energy density is set to 100 to 400 $mJ/cm^2$ (typically 200 to 300 $mJ/cm^2$). If a YAG laser is used, second harmonic thereof is employed and the pulse oscillation frequency is set to 30 to 300 kHz while setting the laser energy density to 300 to 600 $mJ/cm^2$ (typically 350 to 500 $mJ/cm^2$). The laser light is collected into a linear beam having a width of 100 to 1000 μm, for example, 400 μm, to irradiate the entire substrate. The substrate is irradiated with the linear laser light with the beams overlapping each other at an overlap ratio of 50 to 90%.

Next, a gate insulating film 5007 is formed so as to cover the island-like semiconductor layers 5004 to 5006. The gate insulating film 5007 is formed from an insulating film containing silicon by plasma CVD or sputtering to a thickness of 40 to 150 nm. In this embodiment, a silicon oxynitride film having a thickness of 120 nm is used. Needless to say, the gate insulating film is not limited to a silicon oxynitride film but may be a single layer or a laminate of other insulating films containing silicon. For example, if a silicon oxide film is used for the gate insulating film, the film is formed by plasma CVD in which TEOS (tetraethyl orthosilicate) is mixed with $O_2$ and the reaction pressure is set to 40 Pa, the substrate temperature to 300 to 400° C., the frequency is set high to 13.56 MHz, and the power density is set to 0.5 to 0.8 $W/cm^2$ for electric discharge. The silicon oxide film thus formed can provide the gate insulating film with excellent characteristics when it is subjected to subsequent thermal annealing at 400 to 500° C.

On the gate insulating film 5007, a first conductive film 5008 and a second conductive film 5009 for forming gate electrodes are formed. In this embodiment, the first conductive film 5008 is a Ta film with a thickness of 50 to 100 nm and the second conductive film 5009 is a W film with a thickness of 100 to 300 nm.

The Ta film is formed by sputtering in which Ta as a target is sputtered with Ar. In this case, An appropriate amount of Xe or Kr is added to Ar to ease the internal stress of the Ta film and thus prevent the Ta film from peeling off. The resistivity of a Ta film in a phase is about 20 μΩcm and is usable for a gate electrode. On the other hand, the resistivity of a Ta film in β phase is about 180 μΩcm and is not suitable for a gate electrode. A Ta film in α phase can readily be obtained when a base with a thickness of about 10 to 50 nm is formed from tantalum nitride that has a crystal structure approximate to that of the α phase Ta film.

The W film is formed by sputtering with W as a target. Alternatively, the W film may be formed by thermal CVD using tungsten hexafluoride ($WF_6$). In either case, the W film has to have a low resistivity in order to use the W film as a gate electrode. A desirable resistivity of the W film is 20 μΩcm or lower. The resistivity of the W film can be reduced by increasing the crystal grain size but, if there are too many impurity elements such as oxygen in the W film, crystallization is inhibited to raise the resistivity. Accordingly, when the W film is formed by sputtering, a W target with a purity of 99.9999% is used and a great care is taken not to allow impurities in the air to mix in the W film being formed. As a result, the W film can have a resistivity of 9 to 20 μΩcm.

Although the first conductive film 5008 is a Ta film and the second conductive film 5009 is a W film in this embodiment, there is no particular limitation. The conductive films may be formed of any element selected from the group consisting of Ta, W, Ti, Mo, Al, and Cu, or of an alloy material or compound material mainly containing the elements listed above. A semiconductor film, typically a polycrystalline silicon film doped with an impurity element such as phosphorus, may be used instead. Other desirable combinations of materials for the first and second conductive films than the one shown in this embodiment include: tantalum nitride (TaN) for the first conductive film 5008 and W for the second conductive film 5009; tantalum nitride (TaN) for the first conductive film 5008 and Al for the second conductive film 5009; and tantalum nitride (TaN) for the first conductive film 5008 and Cu for the second conductive film 5009. (FIG. 21A)

Next, a resist mask 5010 is formed to carry out first etching treatment for forming electrodes and wiring lines. In this embodiment, ICP (inductively coupled plasma) etching is employed in which $CF_4$ and $Cl_2$ are mixed as etching gas and an RF (13.56 MHz) power of 500 W is given to a coiled electrode at a pressure of 1 Pa to generate plasma. The substrate side (sample stage) also receives an RF (13.56 MHz) power of 100 W so that a substantially negative self-bias voltage is applied. When the mixture of $CF_4$ and $Cl_2$ is used, the W film and the Ta film are etched to the same degree.

Under the above etching conditions, if the resist mask is properly shaped, the first conductive film and the second conductive film are tapered around the edges by the effect of the bias voltage applied to the substrate side. The angle of the tapered portions is 15 to 45°. In order to etch the conductive films without leaving any residue on the gate insulating film, the etching time is prolonged by about 10 to 20%. The selective ratio of the W film to the silicon oxynitride film is 2 to 4 (typically 3), and therefore a region where the silicon oxynitride film is exposed is etched by about 20 to 50 nm by the over-etching treatment. In this way, first shape conductive layers 5011 to 5015 (first conductive layers 5011*a* to 5015*a* and second conductive layers 5011*b* to 5015*b*) are formed from the first conductive film and the second conductive film through the first etching treatment. At this point, regions of the gate insulating film 5007 that are not covered with the first shape-conductive layers 5011 to 5015 are etched and thinned by about 20 to 50 nm.

Figure 21B:
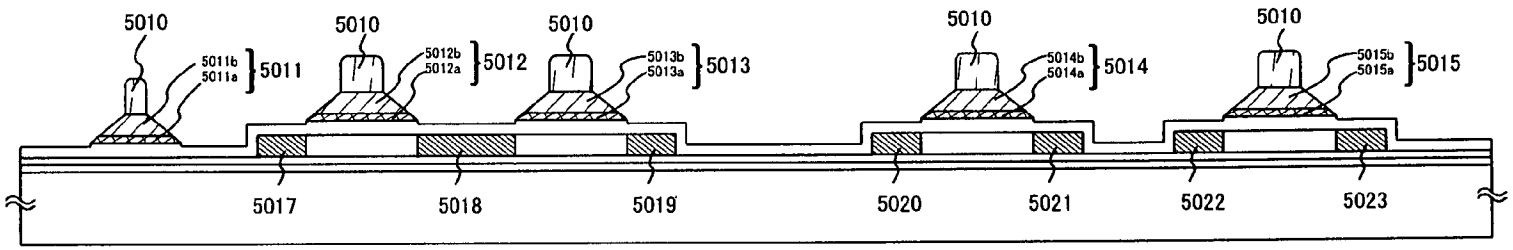

First doping treatment is conducted next for doping of an impurity element that gives the n type conductivity. Ion doping or ion implanting is employed. In ion doping, the dose is set to $1\times10^{13}$ to $5\times10^{14}$ $atoms/cm^2$ and the acceleration voltage is set to 60 to 100 keV. The impurity element that gives the n type conductivity is an element belonging to Group 15, typically, phosphorus (P) or arsenic (As). Here, phosphorus (P) is used. In this case, the conductive layers 5012 to 5015 serve as masks against the impurity element that gives the n type conductivity, and first impurity regions 5017 to 5023 are formed in a self-aligning manner. The first impurity regions 5017 to 5023 each contain the impurity element that gives the n type conductivity in a concentration of $1\times10^{20}$ to $1\times10^{21}$ atoms/cm$^3$. (FIG. 21B)

Figure 21C:
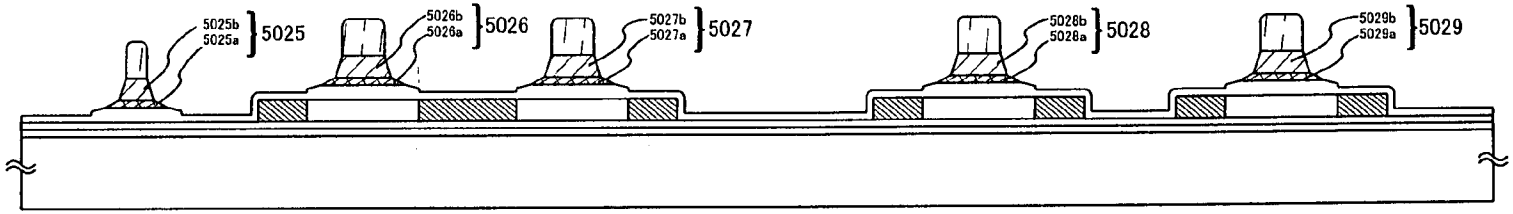

Next, second etching treatment is conducted while leaving the resist mask in place as shown in FIG. 21C. $CF_4$, $Cl_2$, and $O_2$ are used as etching gas to etch the W film selectively. Through the second etching treatment, second shape conductive layers 5025 to 5029 (first conductive layers 5025*a* to 5029*a* and second conductive layers 5025*b* to 5029*b*) are formed. At this point, regions of the gate insulating film 5007 that are not covered with the second shape conductive layers 5025 to 5029 are further etched and thinned by about 20 to 50 nm.

The reaction of the W film and the Ta film to etching by the mixture gas of $CF_4$ and $Cl_2$ can be deduced from the vapor pressure of radical or ion species generated and of reaction products. Comparing the vapor pressure among fluorides and chlorides of W and Ta, $WF_6$ that is a fluoride of W has an extremely high vapor pressure while the others, namely, $WCl_5$, $TaF_5$, and $TaCl_5$ have a vapor pressure of about the same degree. Accordingly, the W film and the Ta film are both etched with the mixture gas of $CF_4$ and $Cl_2$. However, when an appropriate amount of $O_2$ is added to this mixture gas, $CF_4$ and $O_2^-$ react to each other to be changed into CO and F, generating a large amount of F radicals or F ions. As a result, the W film whose fluoride has a high vapor pressure is etched at an increased etching rate. On the other hand, the etching rate of the Ta film is not increased much when F ions are increased in number. Since Ta is more easily oxidized than W, the addition of $O_2$ results in oxidization of the surface of the Ta film. The oxide of Ta does not react with fluorine or chlorine and therefore the etching rate of the Ta film is reduced further. Thus a difference in etching rate is introduced between the W film and the Ta film, so that the etching rate of the W film is set faster than the etching rate of the Ta film.

Figure 22A:
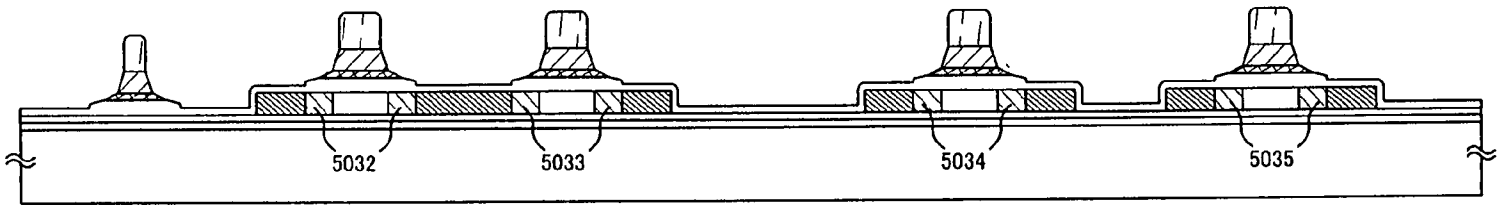
FIGS. 22A to 22C are diagrams showing the method of manufacturing a light emitting device according to the present invention.

Then second doping treatment is conducted as shown in FIG. 22A. In the second doping treatment, the film is doped with an impurity element that gives the n type conductivity in a dose smaller than in the first doping treatment and at a high acceleration voltage. For example, the acceleration voltage is set to 70 to 120 keV and the dose is set to $1\times10^{13}$ atoms/cm$^2$ to form new impurity regions inside the first impurity regions that are formed in the island-like semiconductor layers in FIG. 21B. While the second shape conductive layers 5026 to 5029 are used as masks against the impurity element, regions under the first conductive layers 5026*a* to 5029*a* are also doped with the impurity element. Thus formed are third impurity regions 5032 to 5035. The third impurity regions 5032 to 5035 contain phosphorus (P) with a gentle concentration gradient that conforms with the thickness gradient in the tapered portions of the first conductive layers 5026*a* to 5029*a*. In the semiconductor layers that overlap the tapered portions of the first conductive layers 5026*a* to 5029*a*, the impurity concentration is slightly lower around the center than at the edges of the tapered portions of the first conductive layers 5026*a* to 5029*a*. However, the difference is very slight and almost the same impurity concentration is kept throughout the semiconductor layers.

Figure 22B:
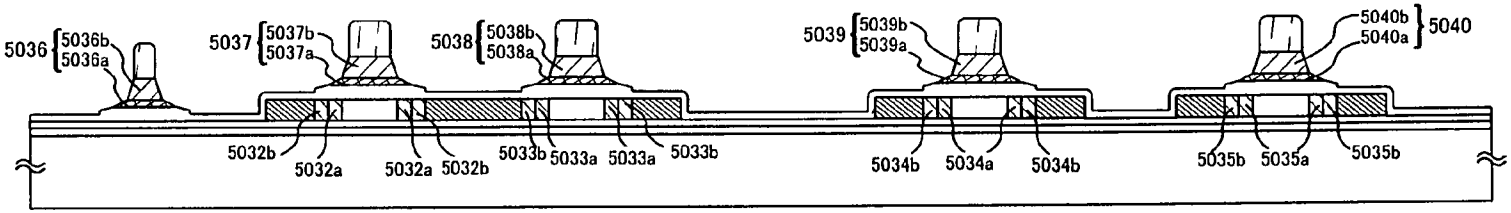

Third etching treatment is then carried out as shown in FIG. 22B. $CHF_6$ is used as etching gas, and reactive ion etching (RIE) is employed. Through the third etching treatment, the tapered portions of the first conductive layers 5025*a* to 5029*a* are partially etched to reduce the regions where the first conductive layers overlap the semiconductor layers. Thus formed are third shape conductive layers 5036 to 5040 (first conductive layers 5036*a* to 5040*a* and second conductive layers 5036*b* to 5040*b*). At this point, regions of the gate insulating film 5007 that are not covered with the third shape conductive layers 5036 to 5040 are further etched and thinned by about 20 to 50 nm.

Third impurity regions 5032 to 5035 are formed through the third etching treatment. The third impurity regions 5032 to 5035 consist of third impurity regions 5032*a* to 5035*a* that overlap the first conductive layers 5037*a* to 5040*a*, respectively, and third impurity regions 5032*b* to 5035*b* each formed between a first impurity region and a second impurity region.

Figure 22C:
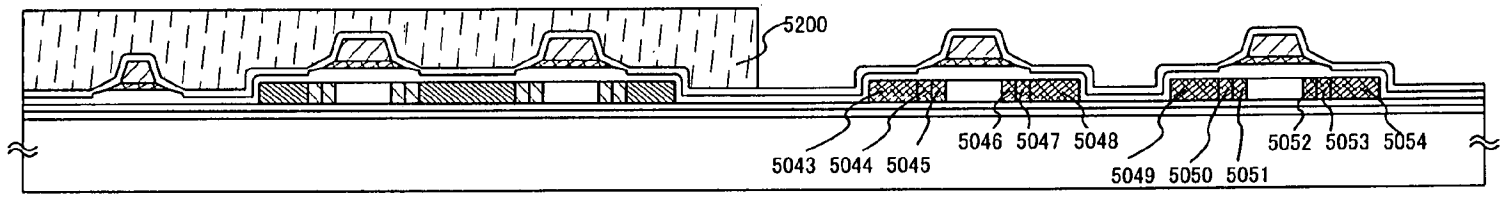

As shown in FIG. 22C, fourth impurity regions 5043 to 5054 having the opposite conductivity type to the first conductivity type are formed in the island-like semiconductor layers 5005 and 5006 for forming p-channel TFTs. The third shape conductive layers 5039*b* and 5040*b* are used as masks against the impurity element and impurity regions are formed in a self-aligning manner. At this point, the island-like semiconductor layer 5004 for forming n-channel TFTs and the wiring line 5036 are entirely covered with a resist mask 5200. The impurity regions 5043 to 5054 have already been doped with phosphorus in different concentrations. The impurity regions 5043 to 5054 are doped with diborane ($B_2H_6$) through ion doping such that diborane dominates phosphorus in each region and each region contain the impurity element in a concentration of $2\times10^{20}$ to $2\times10^{21}$ atoms/cm$^3$.

Through the steps above, the impurity regions are formed in the respective island-like semiconductor layers. The third shape conductive layers 5037 to 5040 overlapping the island-like semiconductor layers function as gate electrodes. The layers 5036 function as island-like source signal lines.

After the resist mask 5200 is removed, the impurity elements used to dope the island-like semiconductor layers in order to control the conductivity types are activated. The activation step is carried out by thermal annealing using an annealing furnace. Other activation methods adoptable include laser annealing and rapid thermal annealing (RTA). The thermal annealing is conducted in a nitrogen atmosphere with an oxygen concentration of 1 ppm or less, preferably 0.1 ppm or less, at 400 to 700° C., typically 500 to 600° C. In this embodiment, the substrate is subjected to heat treatment at 500° C. for four hours. However, if the wiring line material used for the third shape conductive layers 5036 to 5040 are weak against heat, the activation is desirably made after an interlayer insulating film (mainly containing silicon) is formed in order to protect the wiring lines and others.

Another heat treatment is conducted in an atmosphere containing 3 to 100% hydrogen at 300 to 450° C. for one to twelve hours, thereby hydrogenating the island-like semiconductor layers. The hydrogenation steps is to terminate dangling bonds in the semiconductor layers using thermally excited hydrogen. Alternatively, plasma hydrogenation (using hydrogen that is excited by plasma) may be employed.

Figure 23A:
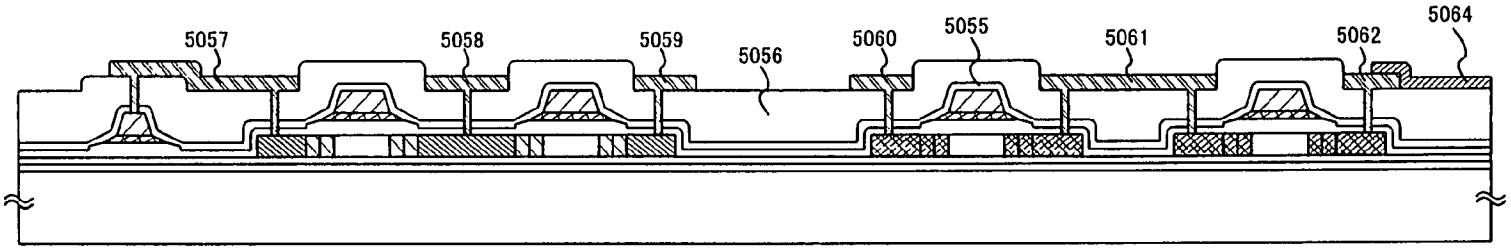
FIGS. 23A and 23B are diagrams showing the method of manufacturing a light emitting device according to the present invention.

As shown in FIG. 23A, a first interlayer insulating film 5055 is formed next from a silicon oxynitride film with a thickness of 100 to 200 nm. A second interlayer insulating film 5056 is formed thereon from an organic insulating material. Thereafter, contact holes are formed through the first interlayer insulating film 5055, the second interlayer insulating film 5056, and the gate insulating film 5007. Connection wiring lines 5057 to 5062 are formed by patterning. The connection wiring line (drain wiring line) 5062 is in contact with a pixel electrode 5064, which is formed by patterning. The connection wiring lines include source wiring lines and drain wiring lines. A source wiring line is a wiring line connected to a source region of an active layer and a drain wiring line is a wiring line connected to a drain region of the active layer.

The second interlayer insulating film 5056 is a film made of an organic resin. Examples of the usable organic resin includes polyimide, polyamide, acrylic resin, and BCB (benzocyclobutene). Since planarization is a significant aspect of the role of the second interlayer insulating film 5056, acrylic resin that can level the surface well is particularly preferable. In this embodiment, the acrylic film is thick enough to eliminate the level differences caused by the TFTs. An appropriate thickness of the film is 1 to 5 μm (preferably 2 to 4 μm).

The contact holes are formed by dry etching or wet etching, and include contact holes reaching the impurity regions 5017 to 5019 having the n type conductivity or the impurity regions 5043, 5048, 5049, and 5054 having the p type conductivity, a contact hole reaching the wiring line 5036, a contact hole (not shown) reaching a power supply line, and contact holes (not shown) reaching the gate electrodes.

The connection wiring lines 5057 to 5062 are obtained by patterning a laminate with a three-layer structure into a desired shape. The laminate consists of a Ti film with a thickness of 100 nm, a Ti-containing aluminum film with a thickness of 300 nm, and a Ti film with a thickness of 150 nm which are successively formed by sputtering. Other conductive films may of course be used.

The pixel electrode 5064 in this embodiment is obtained by patterning an ITO film with a thickness of 110 nm. A contact is made by arranging the pixel electrode 5064 so as to overlap the connection wiring line 5062. The pixel electrode may instead be formed of a transparent conductive film in which indium oxide is mixed with 2 to 20% zinc oxide (ZnO). The pixel electrode 5064 serves as an anode of an EL element. (FIG. 23A)

Figure 23B:
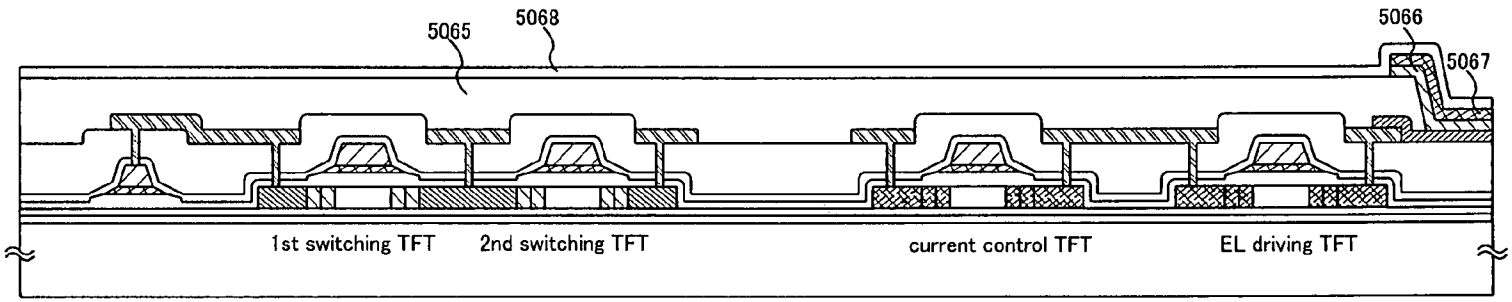

Next, as shown in FIG. 23B, an insulating film containing silicon (a silicon oxide film, in this embodiment) is formed to a thickness of 500 nm and an aperture is opened in the film at a position corresponding to the position of the pixel electrode 5064. A third interlayer insulating film 5065 functioning as a bank is thus formed. The aperture is formed using wet etching, thereby readily forming tapered side walls. If the side walls of the aperture is not smooth enough, the level difference can make degradation of an EL layer into a serious problem. Therefore attention must be paid.

An EL layer 5066 and a cathode (MgAg electrode) 5067 are formed by vacuum evaporation successively without exposing the substrate to the air. The thickness of the EL layer 5066 is set to 80 to 200 nm (typically 100 to 120 nm). The thickness of the cathode 5067 is set to 180 to 300 nm (typically 200 to 250 nm).

In this step, the EL layer and the cathode are formed in a pixel for red light, then in a pixel for green light, and then in a pixel for blue light. The EL layers have low resistivity to solutions, inhibiting the use of photolithography. Therefore an EL layer of one color cannot be formed together with an EL layer of another color. Then EL layers and cathodes are selectively formed in pixels of one color while covering pixels of the other two colors with a metal mask.

To elaborate, first, a mask that covers all the pixels except pixels for red light is set and EL layers for emitting red light are selectively formed using the mask. Then a mask that covers all the pixels except pixels for green light is set and EL layers for emitting green light are selectively formed using the mask. Lastly, a mask that covers all the pixels except pixels for blue light is set and EL layers for emitting blue light are selectively formed using the mask. Although different masks are used in the description here, the same mask may be used three times for forming the EL layers of three colors.

Formed here are three types of EL elements in accordance with R, G, and B. Instead, a white light emitting EL element combined with color filters, a blue light or bluish green light emitting element combined with fluorophors (fluorescent color conversion layers: CCM), or overlapped RGB EL elements with a cathode (opposite electrode) formed of a transparent electrode may be used.

A known material can be used for the EL layer 5066. A preferable known material is an organic material, taking the driving voltage into consideration. For example, the EL layer has a four-layer structure consisting of a hole injection layer, a hole transporting layer, a light emitting layer, and an electron injection layer.

The cathode 5067 is formed next. This embodiment uses MgAg for the cathode 5067 but it is not limited thereto. Other known materials may be used for the cathode 5067.

Lastly, a passivation film 5068 is formed from a silicon nitride film with a thickness of 300 nm. The passivation film 5068 protects the EL layer 5066 from moisture and the like, thereby further enhancing the reliability of the EL element. However, the passivation film 5068 may not necessarily be formed.

A light emitting device structured as shown in FIG. 23B is thus completed. In the process of manufacturing a light emitting device according to the present invention, the source signal lines are formed of Ta and W that are the materials of the gate electrodes whereas gate signal lines are formed of Al that is the wiring line material for forming the source and drain electrodes in consideration of circuit structure and the process. However, different materials may also be used.

The light emitting device of this embodiment exhibits very high reliability and improved operation characteristics owing to placing optimally structured TFTs in not only the pixel portion but also in the driving circuits. In the crystallization step, the film may be doped with a metal catalyst such as Ni to enhance the crystallinity. By enhancing the crystallinity, the drive frequency of the source signal line driving circuit can be set to 10 MHz or higher.

In practice, the device reaching the state of FIG. 23B is packaged (enclosed) using a protective film that is highly airtight and allows little gas to transmit (such as a laminate film and a UV-curable resin film) or a light-transmissive seal, so as to further avoid exposure to the outside air. A space inside the seal may be set to an inert atmosphere or a hygroscopic substance (barium oxide, for example) may be placed there to improve the reliability of the EL element.

After securing the airtightness through packaging or other processing, a connector (flexible printed circuit: FPC) is attached for connecting an external signal terminal with a terminal led out from the elements or circuits formed on the substrate.

By following the process shown in this embodiment, the number of photo masks needed in manufacturing a light emitting device can be reduced. As a result, the process is cut short to reduce the manufacture cost and improve the yield.

The structure of this embodiment can be combined freely with Embodiments 1 through 8.

Embodiment 10

If an EL material that emits light utilizing phosphorescence by a triplet exciton is used in the present invention, the external light emission quantum efficiency can be improved exponentially. The improvement makes it possible to reduce power consumption of the EL element, prolong the lifetime of the EL element, and reduce the weight of the EL element.

Some of the report on improving the external light emission quantum efficiency by utilizing a triplet exciton are given below.

(T. Tsutsui, C. Adachi, S. Saito, Photochemical Processes in Organized Molecular Systems, ed. K. Honda, (Elsevier Sci. Pub., Tokyo, 1991,) p. 437.)

The EL material (coumarin) described in the article above has the following molecular formula.

Chemical Formula I

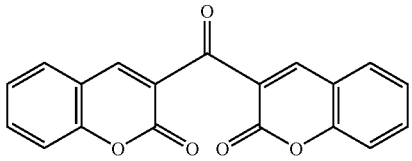

(M. A. Baldo, D. F. O'Brien, Y. You, A. Shoustikov, S. Sibley, M. E. Thompson, S. R. Forrest, Nature 395 (1998) p. 151.)

The EL material (a Pt complex) described in the article above has the following molecular formula.

Chemical Formula 2

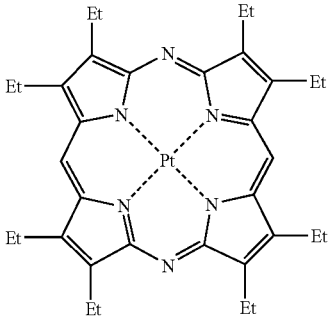

(M. A. Baldo, S. Lamansky, P. E. Burrrows, M. E. Thompson, S. R. Forrest, Appl. Phys. Lett., 75 (1999) p. 4.) (T. Tsutui, M. J. Yang, M. Yahiro, K. Nakamura, T. Watanabe, T. Tsuji, Y Fukuda, T. Wakimoto, S. Mayaguchi, Jpn. Appl. Phys., 38 (12B) (1999) L1502.)

The EL material (an Ir complex) described in the articles above has the following molecular formula.

Chemical Formula 3

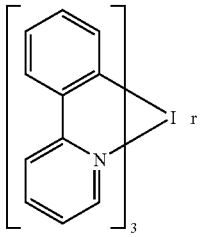

As above, in principle, the use of phosphorescent light emission by a triplet exciton can bring an external light emission quantum efficiency three or four times higher than in the case of using fluorescent light emission by a singlet exciton.

The structure of this embodiment can be freely combined with any of structures of Embodiments 1 through 9.

Embodiment 11

This embodiment describes a case in which an organic semiconductor is used to form an active layer of a TFT employed by a light emitting device of the present invention. Hereinafter, a TFT whose active layer is formed of an organic semiconductor is called an organic TFT.

Figure 27A:
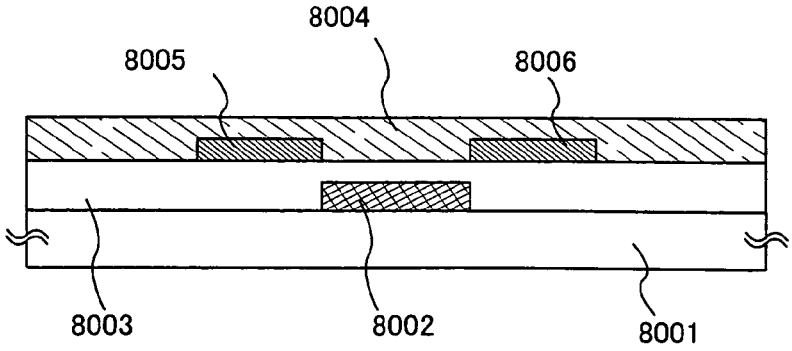
FIGS. 27A to 27C are sectional views of TFTs using an organic semiconductor.

FIG. 27A is a sectional view of a planar organic TFT. A gate electrode 8002 is formed on a substrate 8001. A gate insulating film 8003 is formed on the substrate 8001 while covering the gate electrode 8002. On the gate insulating film 8003, a source electrode 8005 and a drain electrode 8006 are formed. An organic semiconductor film 8004 is formed on the gate insulating film 8003 while covering the source electrode 8005 and the drain electrode 8006.

Figure 27B:
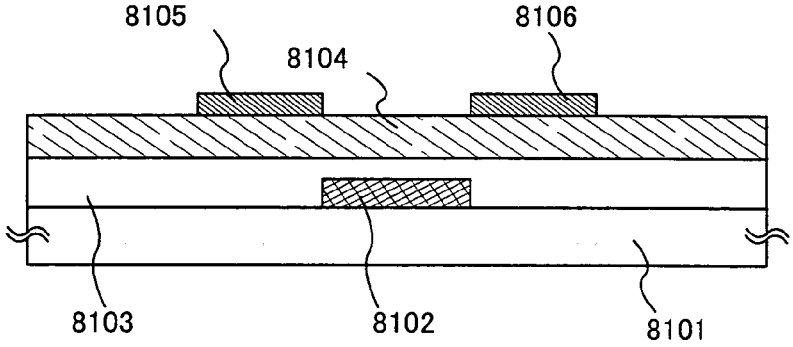

FIG. 27B is a sectional view of a reverse stagger organic TFT. A gate electrode 8102 is formed on a substrate 8101. A gate insulating film 8103 is formed on the substrate 8101 while covering the gate electrode 8102. On the gate insulating film 8103, an organic semiconductor film 8104 is formed. A source electrode 8105 and a drain electrode 8106 are formed on the organic semiconductor film 8104.

Figure 27C:
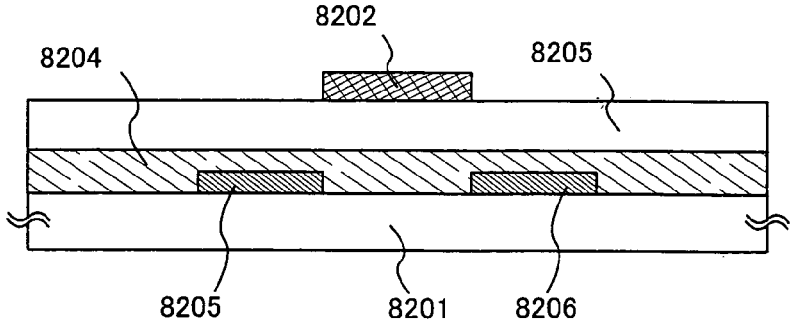

FIG. 27C is a sectional view of a stagger organic TFT. A source electrode 8205 and a drain electrode 8206 are formed on a substrate 8201. An organic semiconductor film 8204 is formed on the substrate 8201 while covering the source electrode 8205 and the drain electrode 8206. On the organic semiconductor film 8204, a gate insulating film 8203 is formed. A gate electrode 8202 is formed on the gate insulating film 8203.

Organic semiconductors are classified into high molecular weight ones and low molecular weight ones. Examples of the typical high molecular weight material include polythiophene, polyacetylene, poly(N-methylpyrrole), poly(3-alkylthiophene), and polyallylenevinylene.

An organic semiconductor film containing polythiophene can be formed by electric field polymerization or vacuum evaporation. An organic semiconductor film containing polyacetylene can be formed by chemical polymerization or application. An organic semiconductor film containing poly (N-methylpyrrole) can be formed by chemical polymerization. An organic semiconductor film containing poly(3-alkylthiophene) can be formed by application or the LB method. An organic semiconductor film containing polyallylenevinylene can be formed by application.

Examples of the typical low molecular weight material include quarter thiophene, dimethyl quarter thiophene, diphthalocyanine, anthracene, and tetracene. Organic semiconductor films containing these low molecular weight materials are mainly formed by evaporation or casting using a solvent.

The structure of this embodiment can be freely combined with any of structures of Embodiments 1 through 10.

Embodiment 12

Since the light emitting device using EL elements is a self light emission type, this light emitting device has high visibility in a light place and a wide view angle, compared to the liquid crystal display devices. Therefore, this light emitting device can be used as a display portion of various electronic equipment.

Given as such electronic equipment of the light emitting device of the present invention are video cameras, digital cameras, goggle type displays (head mounted displays), car navigation systems, audio playback devices (car audio, audio component, and the like) notebook computers, game machines, portable information terminals (mobile computers, cellular phones, portable game machines, electronic books or the like), image playback devices with the recording medium (specifically, the devices with such display as playbacks the recording medium (digital versatile disc (DVD), and the like) and displays the image thereof. In particular, as for the portable information terminal, since the user is likely to see its screen from a slant direction, emphasis is laid on a wide view angle. Therefore, the light emitting devices is preferably used therefor. Specific examples of those are shown in FIG. 24.

Figure 24A:
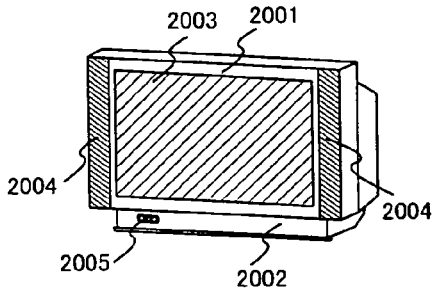
FIGS. 24*a* to 24H are diagrams showing electronic machines to which a light emitting device of the present invention is applied.

FIG. 24A shows an EL display device which is composed of housing 2001, a supporting base 2002, a display portion 2003, a speaker portion 2004, a video input terminal 2005. The light emitting devices of the present invention can be applied to the display portion 2003. Since the light emitting device is a self light emitting type, the back light is unnecessary. As a result, the display portion which is thinner than that of the liquid crystal display device can be obtained. It is to be noted that the EL display device includes all the information display devices to be incorporated in a personal computer, a receiver for TV broadcasting, a display for advertisement, and the like.

Figure 24B:
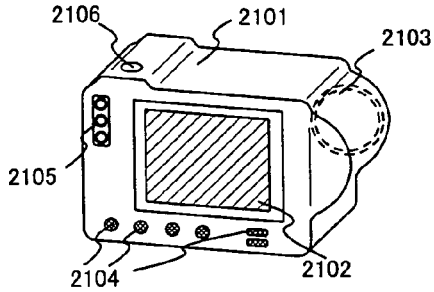

FIG. 24B shows a digital steal camera which is composed of a main body 2101, a display portion 2102, image receiving portion 2103, an operation key 2104, an exterior connection portion 2105, a shutter 2106, and the like. The light emitting devices of the present invention can be applied to the display portion 2102.

Figure 24C:
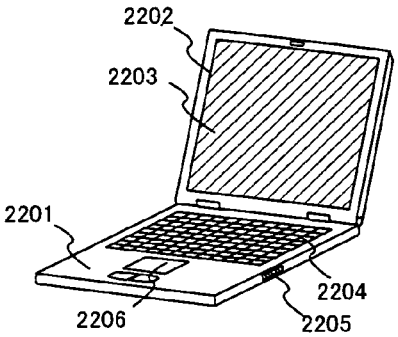

FIG. 24C shows a note computer which is composed of a main body 2201, housing 2202, a display portion 2203, a key board 2204, an exterior connection port 2205, and a pointing mouse 2206, and the like. The light emitting devices of the present invention can be applied to the display portion 2203.

Figure 24D:
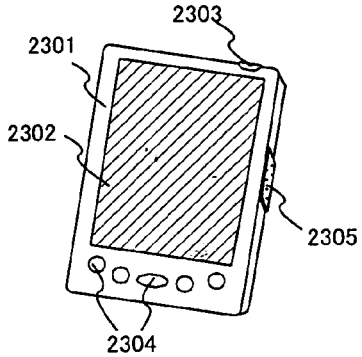

FIG. 24D shows a mobile computer which shows a main body 2301, a display portion 2302, a switch 2303, an operation key 2304, an infrared port 2305, and the like. The light emitting devices of the present invention can be applied to the display portion 2302.

Figure 24E:
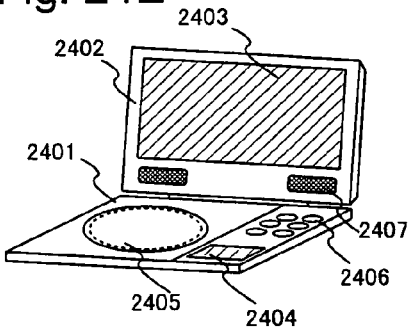

FIG. 24E shows a portable image playback device with a recording medium (specifically, a DVD playback device), which is composed of a main body 2401, housing 2402, a display portion A2403, a display portion B2404, a recording medium (DVD, etc.) reading portion 2405, an operation key 2406, a speaker portion 2407, and the like. The display portion A2403 mainly displays image information, and the display portion B2404 mainly displays letter information. The light emitting device of the present invention can be applied to the display portion A2403 and B2404. The image playback device with the recording medium is incorporated to the domestic game machines.

Figure 24F:
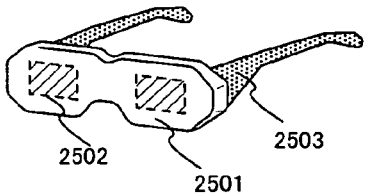

FIG. 24F shows a goggle type displays (head mounted displays) which is composed of a main body 2501, an display portion 2502, and an arm portion 2503. The light emitting devices of the present invention can be applied to the display portion 2502.

Figure 24G:
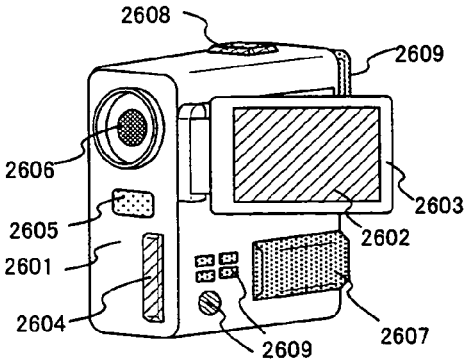
Figure 24H:
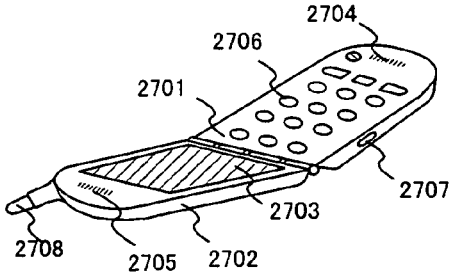
Figure 25:
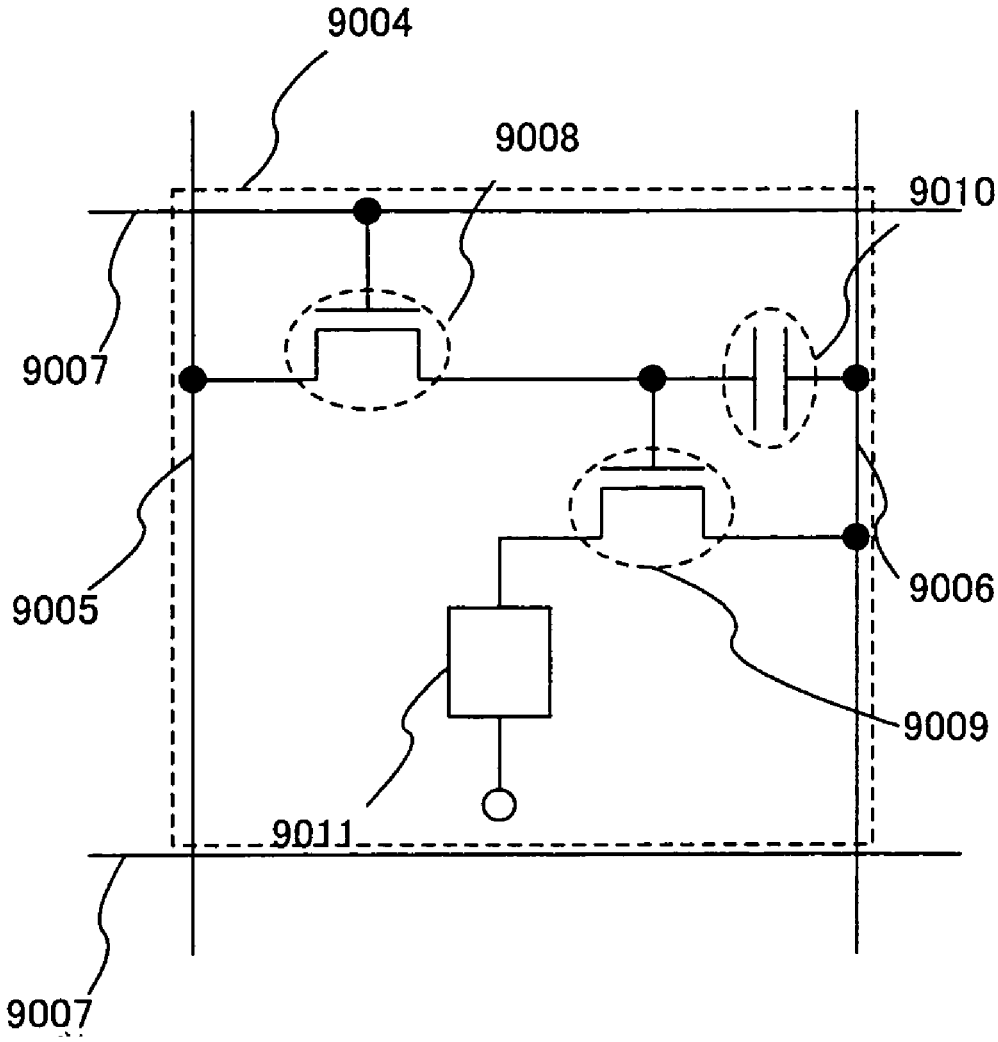
FIG. 25 is a circuit diagram of a pixel in a common light emitting device.

FIG. 24G shows a video camera which is composed of a main body 2601, a display portion 2602, housing 2603, an exterior connection portion 2604, a remote control receiving portion 2605, an image receiving portion 2606, a battery 2607, an audio input portion 2608, an operation key 2609, and the like. The light emitting devices of the present invention can be applied to the display portion 2602.

Figure 26:
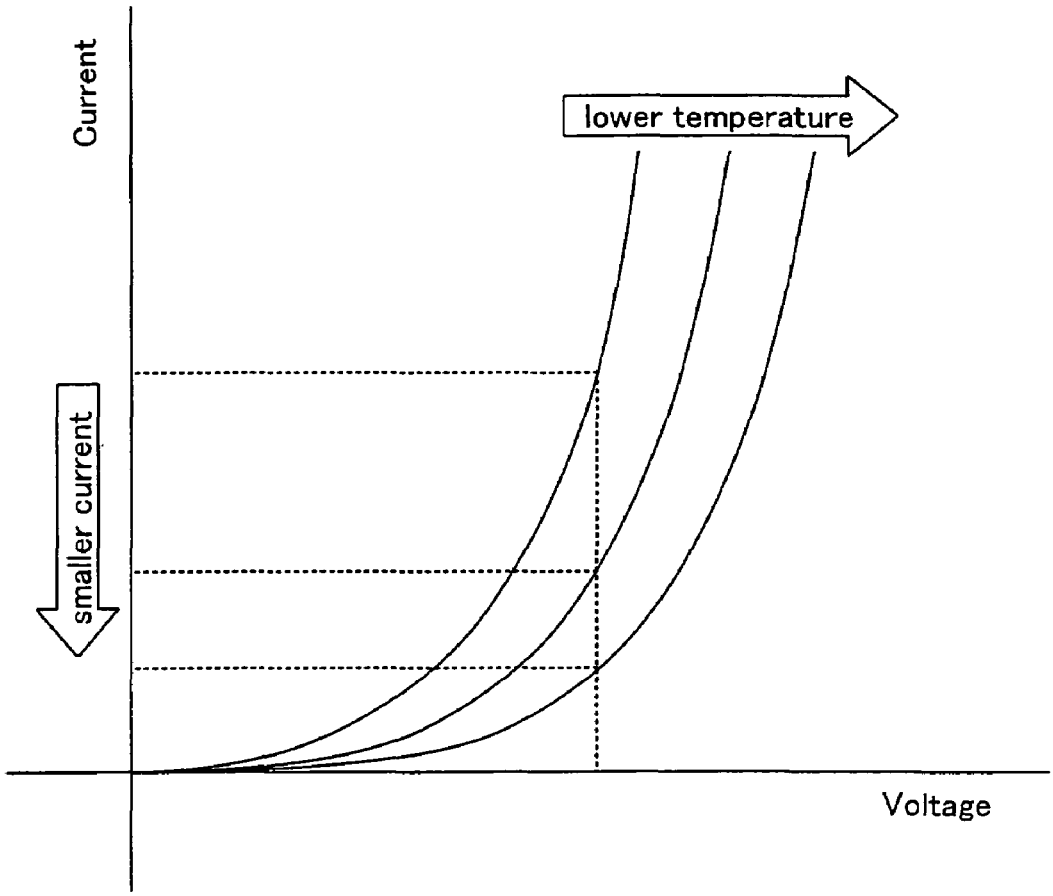
FIG. 26 is a graph showing the voltage-current characteristic of an EL element.

FIG. 26H shows a cellular phone which is composed of a main body 2701, housing 2702, a display portion 2703, an audio input portion 2704, an audio output portion 2705, an operation key 2706, an exterior connection port 2707, an antenna 2708, and the like. The light emitting devices of the present invention can be applied to the display portion 2703. And the display portion 2703 can reduce power consumption of the cellular phone by displaying white letters on the black display.

Note that, if the light emitting luminance of the EL material becomes higher in the future, it is possible to use the EL material to a front type of a rear type projector by magnifying and projecting the light that includes outputted image information with lens etc.

Further, the electronic equipment described above are most likely used for displaying information distributed via electronic communications lines such as Internet and a cable television (CATV). In particular, opportunities are increased in which moving information are displayed. Since the response speed of the EL material is extremely high, the light emitting device is preferably used for displaying motion pictures.

Further, in the light emitting device, only the portion where the light is emitting consumes electric power. Therefore, it is desirable to display the information so that the light emitting portion becomes a little as much as possible. Accordingly, in the portable information terminal, particularly in the case where the light emitting device is used for a display portion that displays mainly character information, such as a cellular phone and an audio playback device, it is desirable to drive the display device such that non-light emitting portion is used as a background, and character information is formed by the light emitting portion.

As described above, the application range of the present invention is so wide that it is applicable to electronic equipment of every field. The electronic equipment of this embodiment can be obtained by any structure resulting from combinations of Embodiments 1 through 11.

With the above structure, the light emitting device of the present invention can obtain a luminance of constant level irrespective of temperature change. Furthermore, if different EL materials are used in EL elements of different colors in order to display in color, temperature change does not cause varying degrees of changes in luminance between the EL elements of different colors and a failure to obtain desired colors is thus avoided.

What is claimed is:

1. A light emitting device having a plurality of pixels each including a first TFT, a second TFT, a third TFT, a fourth TFT, an EL element, a source signal line, a first gate signal line, a second gate signal line different from the first gate signal line, and a power supply line, wherein the third TFT and the fourth TFT are both connected to the first gate signal line at their gate electrodes, wherein the third TFT has a source region and a drain region one of which is connected to the source signal line and the other of which is connected to a drain region of the first TFT, wherein the fourth TFT has a source region and a drain region one of which is connected to the drain region of the first TFT and the other of which is connected to a gate electrode of the first TFT, wherein a source region of the first TFT is connected to the power supply line and the drain region thereof is connected to a source region of the second TFT, wherein a drain region of the second TFT is connected to one of two electrodes of the EL element, and wherein a gate electrode of the second TFT is connected to the second gate signal line.

2. A light emitting device according to claim 1, wherein the third TFT and the forth TFT have the same polarity.

3. A light emitting device according to claim 1, wherein the light emitting device is a device selected from the group of: an EL display device, a digital steal camera, a note computer, a mobile computer, a portable image playback device, a goggle type display, a video camera and cellular phone.

4. A light emitting device having a plurality of pixels each including a first TFT, a second TFT, a third TFT, a fourth TFT, a source signal line, a first gate signal line, a second gate signal line different from the first gate signal line, and a power supply line, wherein the third TFT and the fourth TFT are connected to the first gate signal line at their gate electrodes, wherein the third TFT has a source region and a drain region one of which is connected to the source signal line and the other of which is connected to a drain region of the first TFT, wherein the fourth TFT has a source region and a drain region one of which is connected to the drain region of the first TFT and the other of which is connected to a gate electrode of the first TFT, wherein a source region of the first TFT is connected to the power supply line and the drain region thereof is connected to a source region of the second TFT, and wherein a gate electrode of the second TFT is connected to the second gate signal line.

5. A light emitting device according to claim 4, wherein the third TFT and the forth TFT have the same polarity.

6. A light emitting device according to claim 4, wherein the light emitting device is a device selected from the group of: an EL display device, a digital steal camera, a note computer, a mobile computer, a portable image playback device, a goggle type display, a video camera and cellular phone.

* * * * *